US012007178B2

(12) United States Patent
Gao et al.

(10) Patent No.: US 12,007,178 B2
(45) Date of Patent: Jun. 11, 2024

(54) HEAT EXCHANGER

(71) Applicant: SANHUA (HANGZHOU) MICRO CHANNEL HEAT EXCHANGER CO., LTD., Zhejiang (CN)

(72) Inventors: Qiang Gao, Zhejiang (CN); Xin Liang, Zhejiang (CN); Chaochao Zhang, Zhejiang (CN); Jianlong Jiang, Zhejiang (CN)

(73) Assignee: SANHUA (HANGZHOU) MICRO CHANNEL HEAT EXCHANGER CO., LTD., Zhejiang (CN)

( * ) Notice: Subject to any disclaimer, the term of this patent is extended or adjusted under 35 U.S.C. 154(b) by 254 days.

(21) Appl. No.: 17/419,072

(22) PCT Filed: Dec. 30, 2019

(86) PCT No.: PCT/CN2019/130057
§ 371 (c)(1),
(2) Date: Jun. 28, 2021

(87) PCT Pub. No.: WO2020/135879
PCT Pub. Date: Jul. 2, 2020

(65) Prior Publication Data

US 2022/0074679 A1 Mar. 10, 2022

(30) Foreign Application Priority Data

Dec. 29, 2018 (CN) ..... 201811639355.X
Dec. 29, 2018 (CN) ..... 201910313527.2

(51) Int. Cl.
*F28F 1/12* (2006.01)
*F28F 1/30* (2006.01)
*F28D 21/00* (2006.01)

(52) U.S. Cl.
CPC ..... *F28F 1/128* (2013.01); *F28F 1/30* (2013.01); *F28D 2021/0068* (2013.01); *F28F 2215/04* (2013.01); *F28F 2215/14* (2013.01)

(58) Field of Classification Search
CPC ..... F28F 1/128; F28F 2215/08
See application file for complete search history.

(56) References Cited

U.S. PATENT DOCUMENTS

2011/0036550 A1 2/2011 Jiang et al.
2017/0261271 A1 9/2017 Fanberg et al.

FOREIGN PATENT DOCUMENTS

CN 101619950 A 1/2010
CN 103256850 A 8/2013
(Continued)

OTHER PUBLICATIONS

First Office Action dated Dec. 11, 2020, for Chinese Application No. 201811639355.X.
(Continued)

*Primary Examiner* — Eric S Ruppert
(74) *Attorney, Agent, or Firm* — David D. Brush; Westman, Champlin & Koehler, P.A.

(57) ABSTRACT

A heat exchanger, the heat exchanger including flat tubes and fins. The flat tubes are provided at intervals along the thickness direction of the flat tubes. The flat tubes are internally provided with fluid channels extending along the longitudinal direction of the flat tubes. The fins are provided between adjacent flat tubes. A plurality of fins between adjacent flat tubes are provided at intervals along the transverse direction of the flat tubes. Each fin extends along the longitudinal direction of the flat tubes. Ventilation windows are provided on the fins.

5 Claims, 24 Drawing Sheets

(56) References Cited

FOREIGN PATENT DOCUMENTS

| | | | | |
|---|---|---|---|---|
| CN | 104807360 | A | | 7/2015 |
| CN | 104949395 | A | | 9/2015 |
| CN | 110595250 | A | | 12/2019 |
| JP | 61031890 | A | * | 2/1986 |
| JP | 61089495 | A | * | 5/1986 |
| JP | 04273992 | A | * | 9/1992 |
| JP | H04273992 | A | | 9/1992 |
| JP | 2018017422 | A | | 2/2018 |

OTHER PUBLICATIONS

English translation of the First Office Action dated Dec. 11, 2020, for Chinese Application No. 201811639355.X.
Second Office Action dated Apr. 22, 2021, for Chinese Application No. 201811639355.X.
English translation of the Second Office Action dated Apr. 22, 2021, for Chinese Application No. 201811639355.X.
International Search Report and Written Opinion dated Mar. 16, 2020, for corresponding International Application No. PCT/CN2019/130057, filed Dec. 30, 2019.
English translation of the International Search Report and Written Opiniondated Mar. 16, 2020, for corresponding International Application No. PCT/CN2019/130057, filed Dec. 30, 2019.
First Office Action dated Apr. 14, 2020, for Chinese Application No. 201910313527.2.
English translation of the First Office Action dated Apr. 14, 2020, for Chinese Application No. 201910313527.2.
Second Office Action dated Sep. 11, 2020, for Chinese Application No. 201910313527.2.
English translation of the Second Office Action dated Sep. 11, 2020, for Chinese Application No. 201910313527.2.

* cited by examiner

HEAT EXCHANGER

CROSS-REFERENCE TO RELATED APPLICATIONS

This application is a U.S. national phase entry under 35 U.S.C. § 371 of International Patent Application No. PCT/CN2019/130057, filed on Dec. 30, 2019, which claims the benefit of and priority to Chinese Patent Application Nos. 201811639355.X and 201910313527.2 filed on Dec. 29, 2018, the entire disclosures of which are incorporated herein by reference.

FIELD

This application relates to the field of heat exchange technology, and more particularly to a heat exchanger.

BACKGROUND

For heat exchangers in the related art, especially for parallel-flow multi-channel heat exchangers, refrigerants flow in heat exchange tubes, and exchange heat with air outside the tubes. The heat exchange tubes are designed as flat tubes, and have a plurality of parallel flow channels. Corrugated fins are arranged between flat tubes and provided with louvers. The structure design of the heat exchangers in the related art is not conducive to discharge of condensate water, and degrades heat exchange performance.

SUMMARY

A heat exchanger according to embodiments of the present disclosure includes: a plurality of flat tubes, spaced from each other along a width direction of the flat tubes, in which a fluid channel is arranged in each of the flat tubes and extends along a length direction of the flat tubes, and each of the flat tubes has two main surfaces opposite along a thickness direction of the flat tubes and has two side surfaces opposite along the width direction of the flat tubes; and a fin, arranged between adjacent flat tubes in the thickness direction of the flat tubes, in which a plurality of fins between adjacent flat tubes are spaced apart from each other in the width direction of the flat tubes, and each of the plurality of fins extends along the length direction of the flat tubes and is provided with a ventilation window.

DETAILED DESCRIPTION

Figure 1:
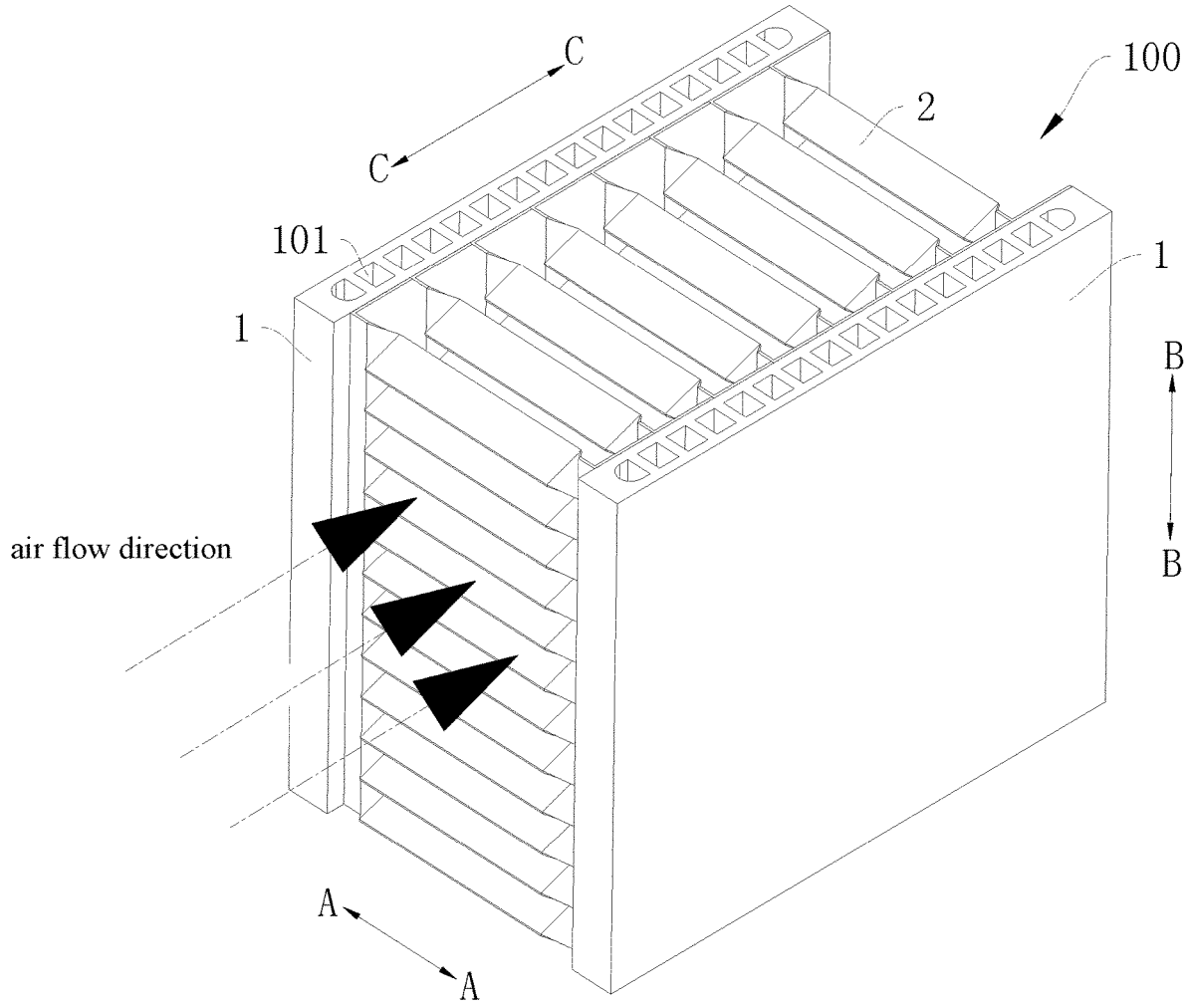
FIG. 1 is a schematic view of a heat exchanger according to an embodiment of the present disclosure.

Embodiments of the present disclosure are described in detail below, and examples of the embodiments are shown in the accompanying drawings. The same or similar elements and the elements having same or similar functions are denoted by like reference numerals throughout the descriptions. The following embodiments described with reference to the accompanying drawings are exemplary and are intended to explain the present disclosure rather than limit the present disclosure.

Referring to FIGS. 1 to 4, a heat exchanger 100 according to embodiments of the present disclosure includes a flat tube 1 and a fin 2. Fluids inside and outside the flat tube 1 can exchange heat through a wall of the flat tube 1, the fin 2, and other structures.

The heat exchanger 100 includes a plurality of flat tubes 1 spaced from each other along a thickness direction of the flat tubes 1 (refer to direction A-A shown in FIG. 1). A fluid channel 101 is arranged in each of the flat tubes 1 and extends along a length direction of the flat tubes 1 (refer to direction B-B shown in FIG. 1). A fluid in the flat tube 1 may circulate through the fluid channel 101. The fin 2 is arranged between adjacent flat tubes 1, and a plurality of fins 2 between adjacent flat tubes 1 are spaced from each other along a width direction of the flat tubes 1 (refer to direction C-C shown in FIG. 1). A fluid (such as gas or condensate water to be subject to heat exchange) may circulate through a gap between the fins 2. Each fin 2 extends along the length direction of the flat tubes 1.

In the heat exchanger 100 according to the embodiments of the present disclosure, either the gap between the fins 2 or a louver may be used as a flow channel for air or condensate water, and the condensate water can be discharged quickly without accumulating on the flat tubes 1 and the fins 2. A fluid outside the flat tubes 1 may be in better contact with structures such as the flat tubes 1 and the fins 2, to carry out heat exchange. Thus, the heat exchange efficiency and condensate water discharge efficiency of the heat exchanger 100 can be effectively improved.

Each flat tube 1 has two main surfaces opposite to each other along the thickness direction of the flat tube 1, and each flat tube 1 has two side surfaces opposite to each other along the width direction of the flat tube 1.

In some embodiments, the plurality of fins are parallel to each other, and a ventilation window 201 is arranged on each fin 2 and runs through a thickness direction of the fin 2. The fluid (such as the gas or the condensate water to be subject to heat exchange) may also circulate through the ventilation window 201.

In the present disclosure, the heat exchanger 100 may be arranged in such a way that the length direction of the flat tubes 1 extends in an up-down direction, while an air flow direction is set along the width direction of the flat tubes 1. When the heat exchanger 100 performs heat exchange (especially heat exchange with air outside the flat tubes 1 by the fluid inside the flat tubes 1), the fluid outside the flat tubes 1 may circulate along the width direction of the flat tubes 1, in which at least a part of the fluid outside the flat tubes 1 is sent to the fins 2 (or a space between the flat tubes 1) along the width direction of the flat tubes 1. When the fluid sent to the fins 2 passes through the fins 2, the fluid passes through the ventilation window 201 on each of the fins 2, and then is discharged between adjacent flat tubes 1 after passing through the plurality of fins 2.

For example, when air outside the flat tubes 1 is cooled by using the heat exchanger 100, air will condense when flowing through the fins 2. That is, water vapor in the air will condense when passing through the fins 2 with a lower temperature, and form droplets after condensation, which condense on structures such as the fins 2 and the flat tubes 1, thus producing condensate water. Since the length direction of the flat tubes 1 extends in the up-down direction, and each fin 2 extends along the length direction of the flat tubes 1, the condensate water will circulate along the length direction of the flat tubes 1 under the action of gravity, and the condensate water on structures such as the flat tubes 1 and the fins 2 will be quickly discharged, to achieve a purpose of rapid discharge of the condensate water.

In addition, due to the rapid discharge of the condensate water, heat or cold absorbed by the condensate water from the fluid inside the flat tubes 1 can be reduced to a certain extent, the loss of heat or cold of the fluid inside the flat tubes 1 can be decreased, and the heat exchange rate and the heat transfer rate can be effectively improved. In some embodiments, when the heat exchanger 100 performs refrigeration, since less condensate water is left on the heat exchanger 100 (or no condensate water remains), the problem of icing caused by accumulation of the condensate water can be effectively reduced, and the problem of low heat exchange efficiency caused by the icing of the heat exchanger 100 can be also avoided, improving energy efficiency of the heat exchanger 100.

In some embodiments, the width direction and the length direction of the flat tubes 1 in the present disclosure are both perpendicular to the thickness direction of the flat tubes 1, and preferably, the width direction and the length direction of the flat tubes 1 are also perpendicular to each other.

In some embodiments, the length direction of each flat tube 1 is an extension direction of the fluid channel 101 or a length direction of the fluid channel 101, and a length direction of each fin 2 is consistent with the length direction of the flat tube 1 or the length direction of the fluid channel 101; the width direction of each flat tube 1 is perpendicular to a thickness direction of the fluid channel 101 and the thickness direction of the flat tube 1; the fins 2 are spaced from each other along the width direction of the flat tube 1.

A transverse direction of the flat tube is the width direction of the flat tube, and the thickness direction of the fin 2 is consistent with the width direction of the flat tube; a longitudinal direction of the fin is consistent with the thickness direction of the flat tube.

In addition, since an extension direction of the fin 2 is consistent with the extension direction of the fluid channel 101 (both extend along the length of the flat tube 1), when the fluid in the flat tube 1 passes through the fluid channel 101, each of the plurality of fins 2 has a same thermal conduction effect. For example, referring to FIG. 1, when the fluid in the flat tube 1 flows along direction B-B, the extension direction of each fin 2 is consistent with the extension direction of the fluid channel 101 in a projection along the thickness direction of the flat tube 1, and in such a case each fin 2 absorbs substantially the same amount of cold and heat, thus allowing for uniform heat exchange.

For convenience of understanding, a counterexample is described. In this counterexample, a plurality of fins are arranged along the length direction of the flat tube, and each fin extends along the width direction of the flat tube. The fluid flows along a longitudinal direction in the fluid channel, and the fluid will exchange heat with the plurality of fins gradually. Since the fluid continually exchanges heat during circulation, the amount of heat or cold in the fluid will be reduced downstream in a flow direction of the fluid. A fin exchanging heat with the fluid firstly will undertake a larger amount of heat or cold, while another fin exchanging heat with the fluid downstream will undertake a smaller amount of heat or cold. As a result, the heat exchange effect of the plurality of fins will be uneven.

In addition, the plurality of fins 2 of the heat exchanger 100 in the present disclosure may be arranged in parallel in the width direction of the flat tube 1, and the thickness direction of each fin 2 is consistent with the width direction of the flat tube 1. The fins 2 are formed by stamping or other methods. During assembly of the heat exchanger 100, the fins 2 can be pushed into between the flat tubes 1 one by one and then be fixed and soldered.

Several structural forms of the fins 2 are illustrated below.

Figure 4:
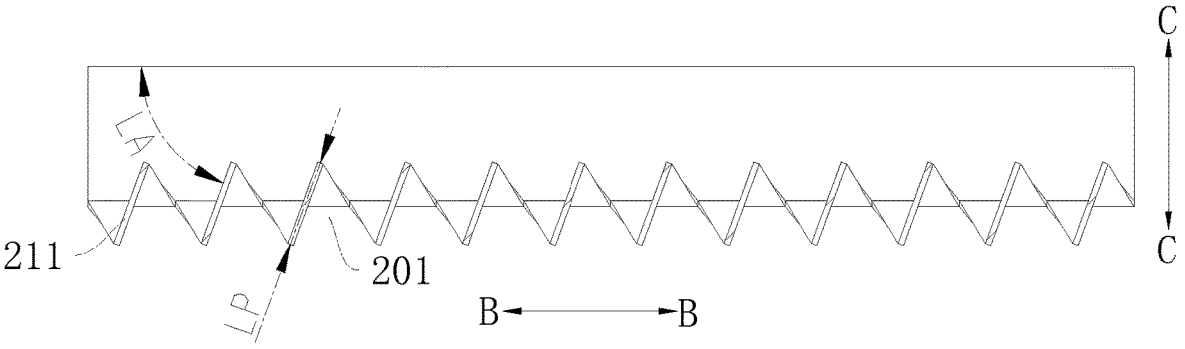
FIG. 4 is a sectional view along line I-I in FIG. 3.

As shown in FIG. 4, a distance between adjacent ventilation windows 201 on a single fin is LP, that is, the distance between two adjacent ventilation windows 201 on a single fin 2 is LP. In addition, an opening angle of the ventilation window 201 is LA. A louvre blade 211 is arranged at the ventilation window 201 and extends obliquely, and an inclined angle of the louvre blade 211 relative to the fin 2 may be less than 90°. That is, the louvre blade 211 is inclined relative to a normal direction of the fin 2 (the width direction of the flat tube 1). Specifically, the opening angle LA of the ventilation window 201 means that an angle between the louvre blade 211 and a plane orthogonal to a plate body of the fin 2 (or rather the length direction of the flat tube 1 in FIG. 4) is LA. In this case, 0.5≤LP≤5 (unit: millimeter), and 45°≤LA≤85°.

In some embodiments, a value of LP may also be set to be less than 0.5 mm or greater than 5 mm, and for example, the value of LP may be set as 0.3 mm, 0.8 mm, 3 mm, and 10 mm.

In some embodiments, a value of LA may also be set to be less than 450 or greater than 85°, and for example, the value of LA may be set as 5°, 25°, 60°, 75°, and 88°.

The value of LP and the value of LA may be adjusted according to actual situations. By defining the value of LP and the value of LA, a heat exchange area between the fin 2 and air may be improved by the louvre blade 211 (more fluid can contact the fin 2), to avoid problems of affecting the structural strength of the fin 2 due to too small a value of LP, affecting the ventilation rate due to too large a value of LP, and affecting a contact area between the fin 2 and air due to too small a value of LA, and affecting the ventilation rate due to too large a value of LA. Hence, the ventilation rate and the heat exchange efficiency can be effectively enhanced while ensuring good ventilation.

In addition, a distance between opposite ventilation windows 201 on two adjacent fins 2 in the width direction of the flat tube 1 may also be set as LP (or other distances), that is, a distance between two adjacent fins 2 may be LP (or other distances).

In the present disclosure, a gap between two adjacent flat tubes 1 may be in a range of 5 mm to 20 mm.

The above structure may be applied to other implementations of the present disclosure.

Referring to FIGS. 1 to 4, the fin 2 of the present disclosure may be made of a flat sheet 21.

The ventilation window 201 is arranged on the flat sheet 21, and the ventilation window 201 includes a louvre blade 211 connected to the flat sheet.

The ventilation window 201 may be made by stamping a part of the flat sheet 21 into a louvre blade 211 connected to the flat sheet 21. That is, stamping a part of the flat sheet 21 will stamp a channel on the flat sheet 21, and the stamped part is formed as the louvre blade 211, which can be inclined to the flat sheet 21 and a normal direction of the flat sheet 21.

The term "stamping" here does not necessarily refer to a stamping process. The fin 2 and the louvre blade 211 may also be formed by bending, integral manufacturing or other method. Of course, the louvre blade 211 may be made and formed by the stamping process.

The ventilation window includes the louvre blade connected to the flat sheet and an opening in the flat sheet.

The above structure may be applied to other implementations of the present disclosure.

Referring to FIGS. 1 to 5, the fin 2 includes a positioning flange 22. In some embodiments, the fin 2 includes the flat sheet and the positioning flange 22; the flat sheet extends along the thickness direction of the flat tube 1, and the flat sheet has two opposite side edges along the thickness direction of the flat tube; the positioning flange of the fin is connected to the side edge of the flat sheet of the fin and extends towards another fin adjacent to this fin, and the positioning flange of the fin has a first end for connecting the flat sheet of the fin and a second end away from the flat sheet of the fin.

The side edge of the flat sheet refers to an edge of the flat sheet on at least one side of two opposite sides along the thickness direction of the flat tube, or an edge of the flat sheet parallel to the length direction of the flat tube. In addition, the longitudinal direction of the fin 2 (or a longitudinal direction of the flat sheet) is consistent with the thickness direction of the flat tube 1, the length direction of the fin 2 (or a transverse direction of the flat sheet) is consistent with the length direction of the flat tube 1, and the thickness direction of the fin 2 (or a thickness direction of the flat sheet) is consistent with the width direction of the flat tube 1.

The structural strength of the fin 2 can be improved by the positioning flange 22, and a contact area between the fin 2 and the flat tube 1 can be increased. While improving the heat exchange efficiency and the heat conduction efficiency, the positioning flange 22 can enhance the connection strength between the fin 2 and the flat tube 1, if the fin 2 and the flat tube 1 need to be connected by welding. In fact, even if the fin 2 and the flat tube 1 are not connected by welding, the fitting strength between the fin 2 and the flat tube 1 can also be improved by the positioning flange 22.

Figure 2:
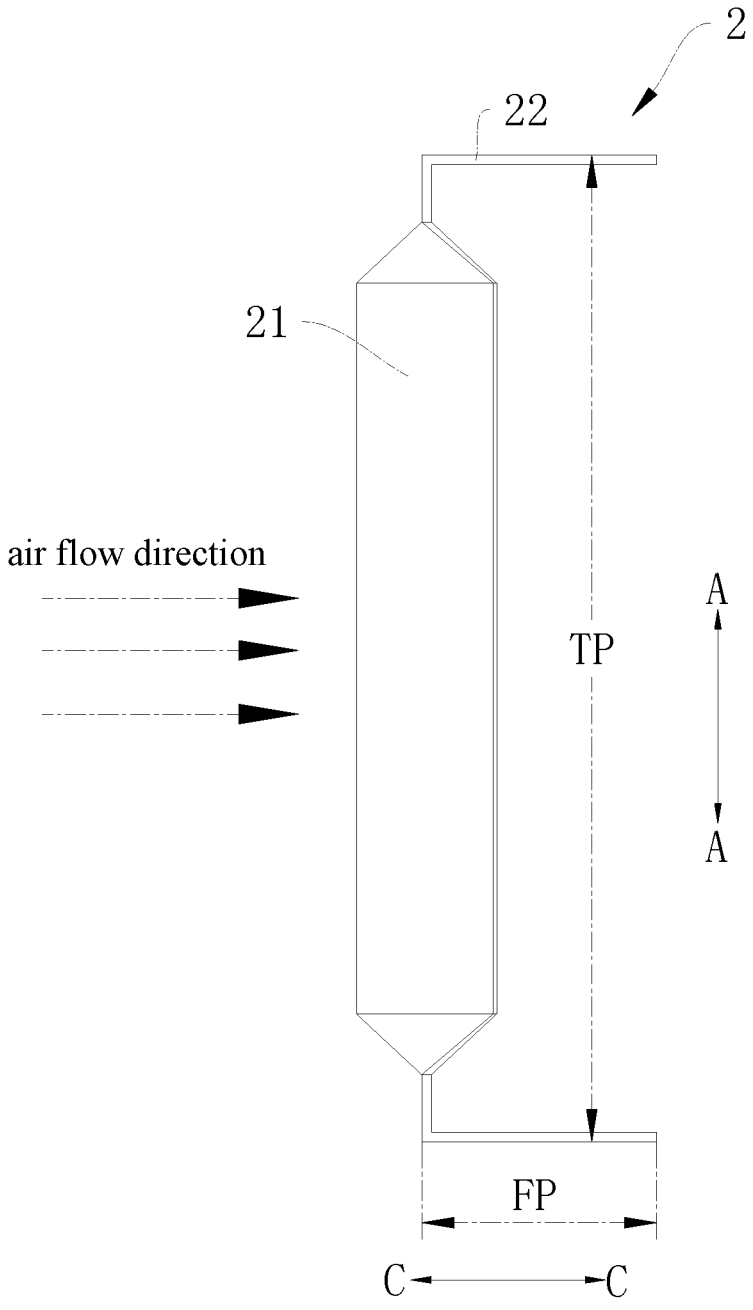
FIG. 2 is a schematic view of a fin of the heat exchanger shown in FIG. 1.
Figure 3:
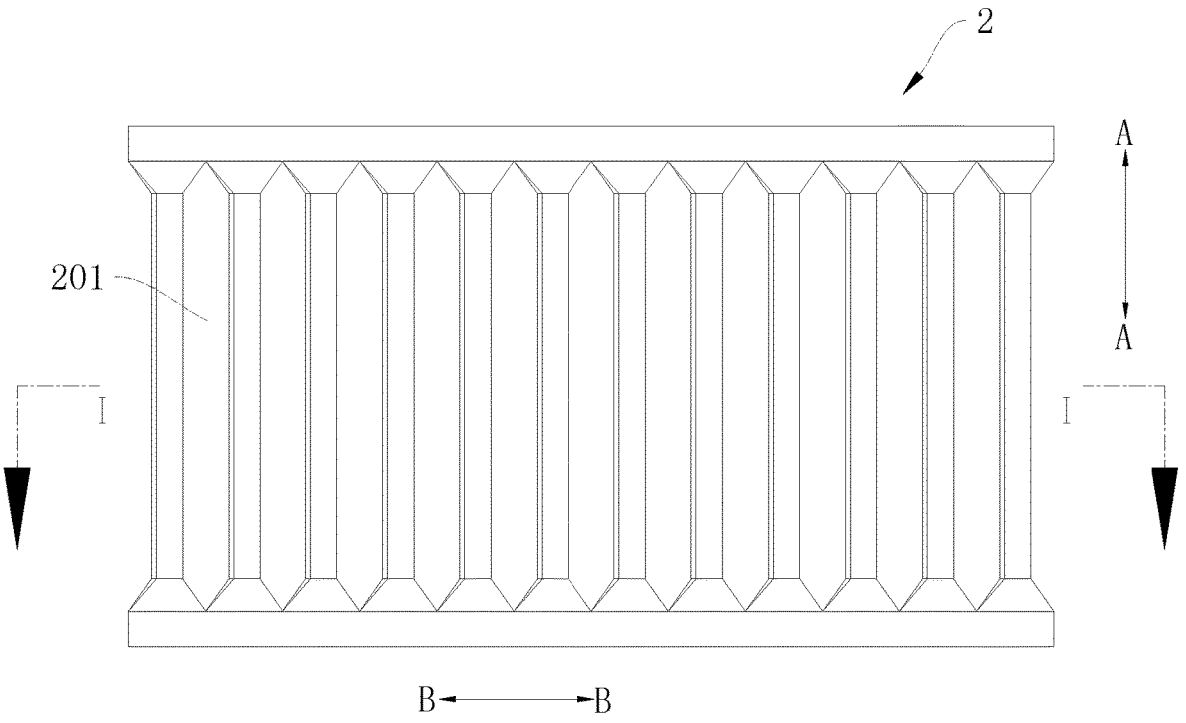
FIG. 3 is a schematic view of the fin of the heat exchanger shown in FIG. 1 in another direction.

In some embodiments, as shown in FIG. 2, the positioning flange 22 extends along the thickness direction of the flat sheet (or the width direction C-C of the flat tube).

The positioning flange of one fin is connected to the side edge of the flat sheet of this fin and extends towards another fin adjacent to this fin. A plurality of ventilation windows are arranged on the flat sheet along the length direction of the flat tube.

In addition, the positioning flange of one fin is connected to the side edge of the flat sheet of this fin and extends towards another fin adjacent to this fin.

In some embodiments, as shown in FIG. 2, the positioning flange 22 is arranged on each longitudinal side edge of the flat sheet on two opposite sides along the longitudinal direction of the fin 2 (or the thickness direction A-A of the flat tube).

In some embodiments, as shown in FIG. 2, the positioning flanges 22 on both sides of the flat sheet extend towards a common side of the fin 2.

In some embodiments, as shown in FIG. 2, the positioning flange 22 is located between two adjacent fins, and has an end connected to the side edge of the flat sheet of the fin. In other words, the positioning flange 22 is located between flat sheets of the two adjacent fins. That is, a gap between two adjacent fins 2 is limited by the positioning flange 22 on the fin 2, so that assembly can be carried out effectively and quickly.

In the two adjacent fins 2, the positioning flange 22 of one fin 2 may abut against the flat sheet 21 of the other fin 2, or the positioning flange 22 of one fin 2 may abut against the positioning flange 22 of the other fin 2.

In addition, in the two adjacent fins 2, the positioning flange 22 of one fin 2 may abut against the positioning flange 22 of the other fin 2 along the thickness direction of the flat tube 1; or the positioning flange 22 of one fin 2 may abut against the other fin 2 along the width direction of the flat tube 1.

Since the positioning flange 22 abuts against the other fin 2, the structural strength between the fins 2 and of the heat exchanger 100 can be improved to a certain extent, and the service life of the heat exchanger 100 can be prolonged, and good stability can also be ensured during the fall of the heat exchanger 100.

Figure 5:
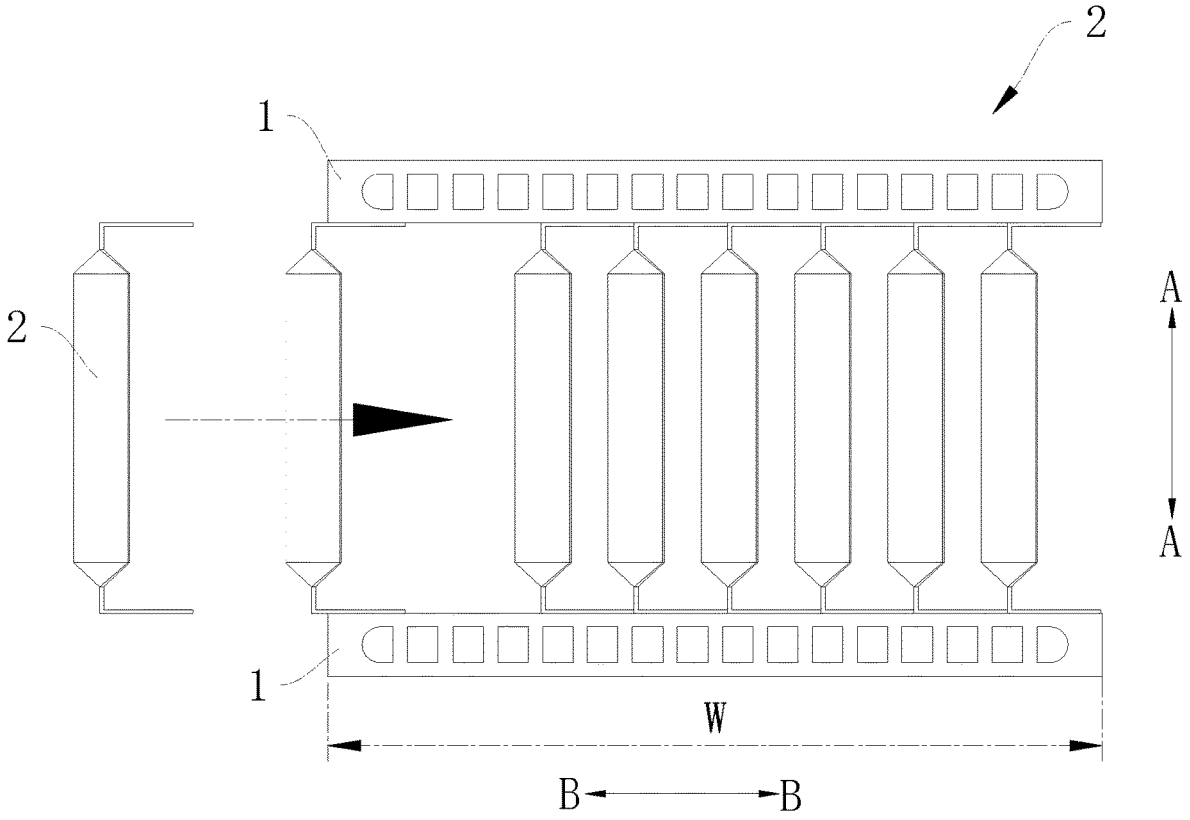
FIG. 5 is a schematic view of an assembly mode of the heat exchanger shown in FIG. 1.

In some embodiments, as shown in FIG. 5, a longitudinal side edge of each fin 2 may abut against the flat tube 1. Alternatively, longitudinal flanges of the plurality of fins 2 may be stacked sequentially on the flat tube 1 along the thickness direction of the flat tube 1, in which case the plurality of fins 2 may be arranged in a mutually nested form.

Referring to FIGS. 2 and 5, the number of the fins 2 between two adjacent flat tubes 1 in the present disclosure is denoted as N, and a width of the positioning flange 22 (a dimension along a width of the flat tube 1) is denoted as FP, in which, the width of the positioning flange 22 may be equal to a distance between fins 2, and the width (a dimension along a transverse direction) of the flat tube 1 may be set as N×FP.

Figure 6:
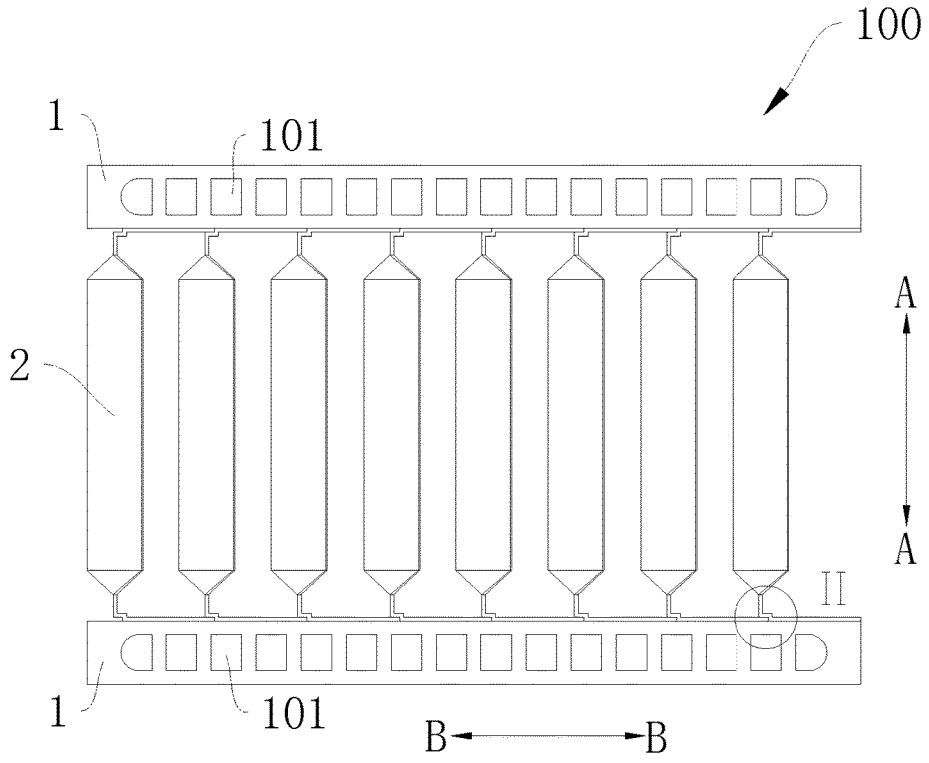
FIG. 6 is a schematic view of a heat exchanger according to another embodiment of the present disclosure.
Figure 7:
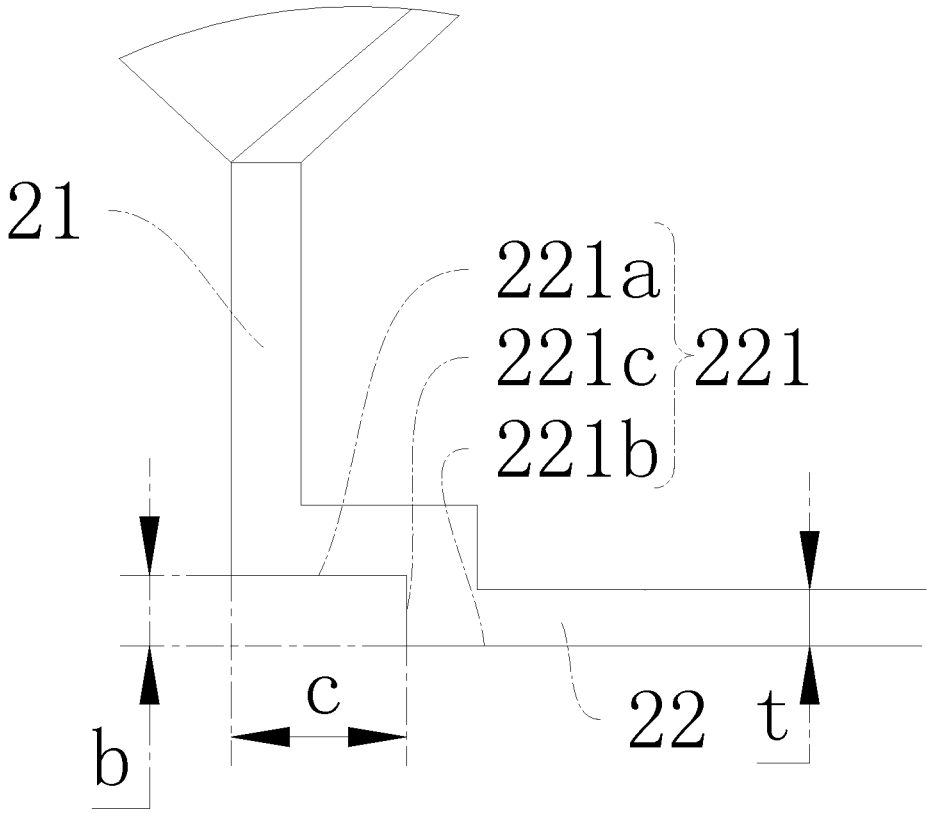
FIG. 7 is a partial enlarged view of a circled area II in FIG. 6.
Figure 8:
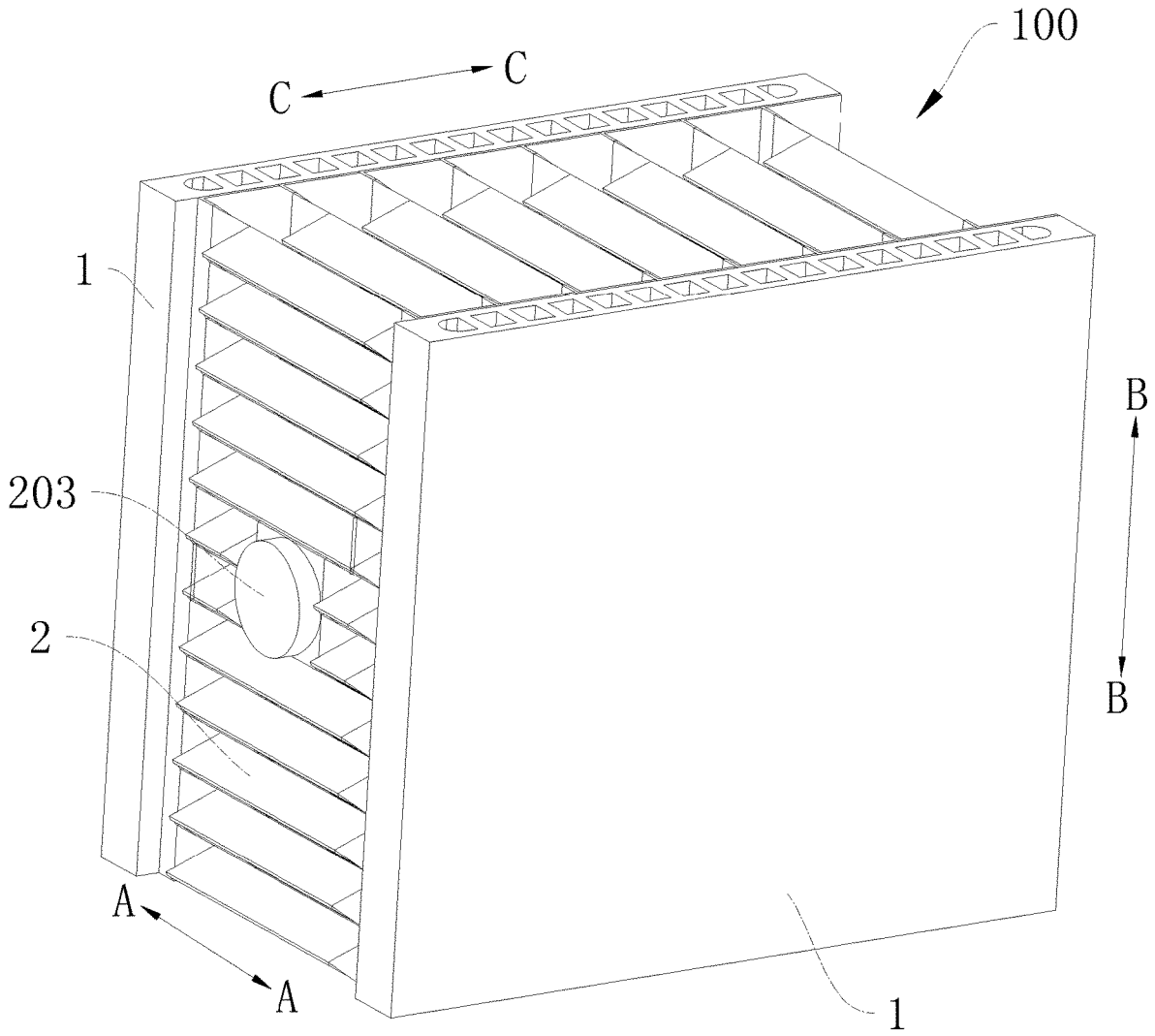
FIG. 8 is a schematic view of a heat exchanger according to still another embodiment of the present disclosure.
Figure 9:
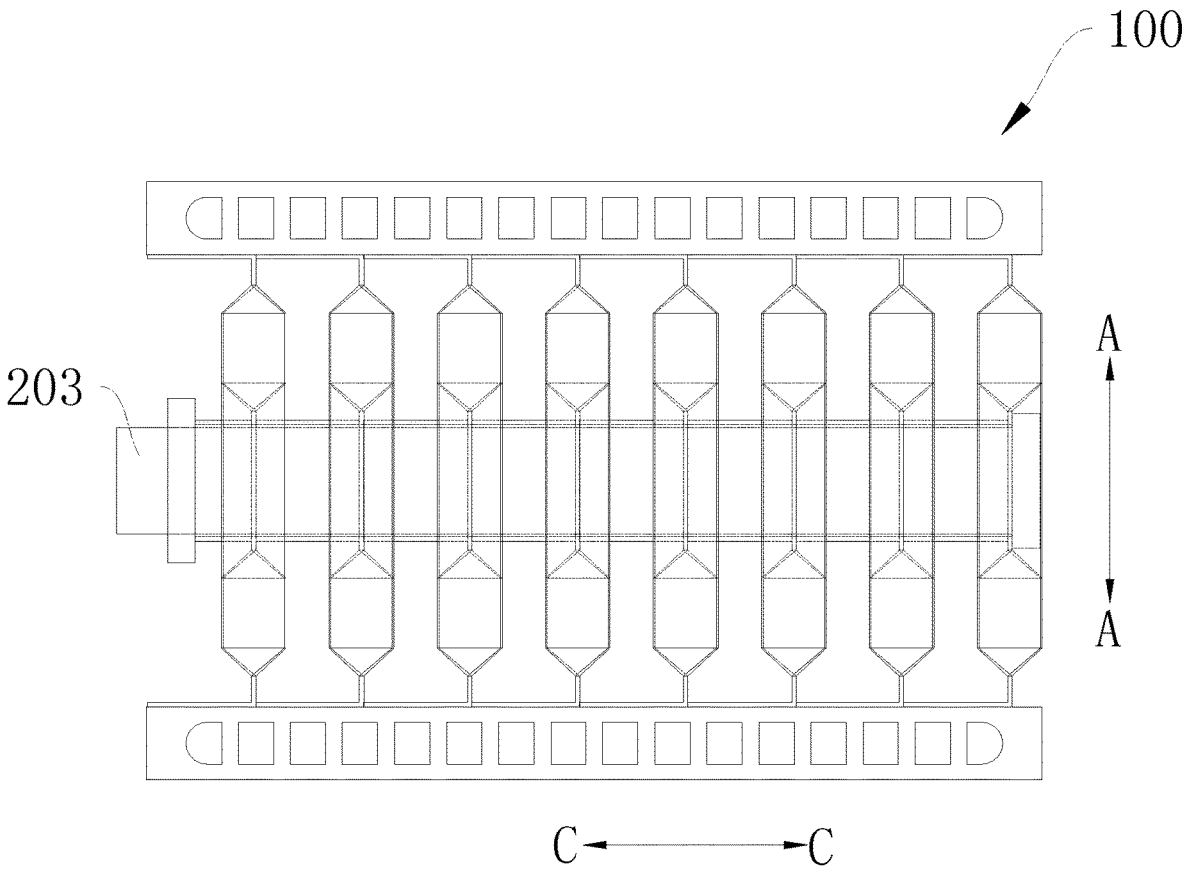
FIG. 9 is a schematic view along direction C-C in FIG. 8.
Figure 10:
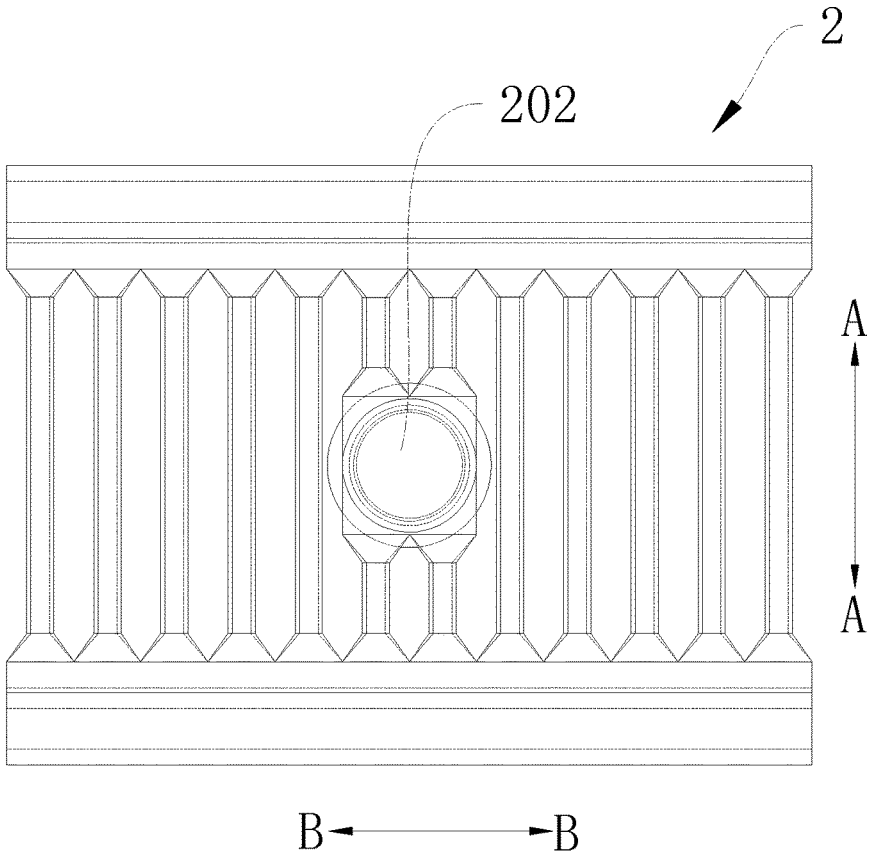
FIG. 10 and FIG. 11 are schematic views of fins of the heat exchanger shown in FIG. 8.

In some embodiments, as shown in FIGS. 6 and 7, the positioning flange 22 may be provided with a first step part 221, and a second end of the positioning flange 22 on one fin 2 abuts against a vertical surface of the first step part 221 of the positioning flange on another adjacent fin.

Specifically, the first end of the positioning flange is provided with the first step part. The first step part of the positioning flange of the fin includes a first step surface and a first vertical surface. The first step surface of the positioning flange of the fin is perpendicularly connected to the flat sheet of the fin and extends along the width direction of the flat tube toward a direction away from the flat sheet of the fin. The first vertical surface of the positioning flange of the fin is perpendicularly connected to the first step surface of the positioning flange of the fin and extends along the thickness direction of the flat tube toward the direction away from of the flat sheet of the fin. The second end of the positioning flange of the fin abuts against the first vertical surface of the first step part of the positioning flange of the adjacent fin.

An inner surface or an outer surface of the positioning flange 22 may include a first step surface 221*a*, a second step surface 221*b*, and a first vertical surface 221*c*. There is a drop between the first step surface 221*a* and the second step surface 221*b* in the thickness direction of the flat tube 1, and the first vertical surface 221*c* is connected between the first step surface 221*a* and the second step surface 221*b*. The first step surface 221*a*, the first vertical surface 221*c*, and the second step surface 221*b* are connected in sequence along the width of the flat tube 1. The first step surface 221*a* and the first vertical surface 221*c* are combined into the first step part 221, in which the first vertical surface 221*c* forms a vertical surface of the positioning flange.

In some embodiments, in the fin 2, the flat sheet 21 is perpendicular to the width of the flat tube 1, and the positioning flange 22 is parallel to the width of the flat tube 1. At this time, an included angle is formed between the positioning flange 22 and the flat sheet 21, in which, a surface of the positioning flange 22 away from the flat sheet 21 along the thickness direction of the flat tube 1 is the outer surface of the positioning flange 22, while a surface of the positioning flange 22 opposite to the outer surface of the positioning flange 22 in the thickness direction of the flat tube 1 is the inner surface of the positioning flange 22.

For example, referring to FIGS. 6 and 7, the outer surface of the positioning flange 22 faces the flat tube 1. The outer surface of the positioning flange 22 includes the first step surface 221*a*, the first vertical surface 221*c*, and the second step surface 221*b* connected in sequence along the width of the flat tube 1, in which the second step surface 221*b* abuts against the flat tube 1, a gap exists between the first step surface 221*a* and the flat tube 1, and the second step surface 221*b* is close to an edge of the second end of the positioning flange 22 relative to the first step surface 221*a*. The second end of the positioning flange 22 of one fin 2 extends into between the first step surface 221*a* of the positioning flange 22 of another fin 2 and the flat tube 1 and abuts against the first vertical surface 221*c* (i.e., the vertical surface).

In some embodiments, a height of the first step part 221 may be equal to a thickness of the positioning flange 22, and the height of the first step part 221 is the drop between the first step surface 221*a* and the second step surface 221*b* in the thickness direction of the flat tube 1. At this time, the stable connection can be realized between the two adjacent fins 2, and between the fins 2 and the flat tube 1, which can effectively improve the heat exchange efficiency of the flat tube 1.

Specifically, referring to the above examples and in combination with FIGS. 6 and 7, the first step surface 221*a* is spaced from a surface of the flat tube 1, while the second step surface 221*b* abuts against the surface of the flat tube 1. Therefore, the height of the first step part 221 is the gap between the first step surface 221*a* and the surface of the flat tube 1. At this time, the positioning flange 22 of another fin 2 may be inserted between the first step surface 221*a* and the flat tube 1, and the second end of the positioning flange 22 of another fin 2 may abut against the surface of the flat tube 1 and the vertical surface.

In other words, the first step part is arranged at the positioning flange 22 of the fin 2 and used to clamp and position each of the plurality of fins 2 in the width of the flat tube 1 and effectively control the distance between fins 2.

In some embodiments, a thickness of the flat sheet of the fin is t, and a depth of the first step part is b. That is, there may be a gap between the first step surface and the flat tube, and a length of the gap in the thickness direction of the flat tube is b, in which t/b is not greater than 0.95.

In some embodiments, a thickness of the fin is t.

The depth of the first step part refers to: a width of the vertical surface; in other words, a dimension of the vertical surface in the thickness direction of the flat tube 1; in other words, a distance between the first step surface and the second step surface in the thickness direction of the flat tube; in other words, a gap between the first step surface 221*a* and the flat tube; in other words, a length, in the thickness direction of the flat tube, of a gap between the first step part and the flat tube.

In some embodiments, a width of the first step part is c, in which c/t is within the range of 1 to 5.

The width of the first step part refers to: a length of the first step surface 221*a* in the width of the flat tube 1, in other words, a length of the first step part in the width direction of the flat tube.

That is, the length of the first step surface in the width direction of the flat tube is c, and the thickness of the flat sheet of the fin is t, in which c/t is within the range of 1 to 5.

In addition, the height of the first step part 221 in the present disclosure may be different from the thickness of the positioning flange 22, and for example, the height of the first step part 221 is greater than or less than the thickness of the positioning flange 22. In some embodiments, when the height of the first step part 221 is large enough, the positioning flanges 22 of the plurality of fins 2 may abut against the vertical surface of the positioning flange 22 of one fin 2.

In some embodiments, the positioning flange 22 includes a first branch, a second branch, and a third branch; the first branch is connected to the flat sheet; and the first branch, the second branch, and the third branch are connected in sequence along the width of the flat tube. A surface of the first branch facing the flat tube is the first step surface, a surface of the third branch facing the flat tube is the second step surface, and a surface of the second branch connecting the first step surface and the second step surface is the first vertical surface.

In some embodiments, the first step surface 211*a* and the first vertical surface 221*c* are connected to form a notch located at the connection of the flat sheet 21 and the positioning flange 22, and the notch is a shape recessed towards the direction away from the flat tube 1.

Referring to FIGS. 8 to 13, at least two fins 2 are provided with connection holes 202, and the plurality of fins 2 are connected together by a connection rod 203 passing through the connection holes 202. That is, the plurality of fins 2 are connected together by the connection rod 203. Such a structure may be applied to other implementations of the present disclosure. In some embodiments, the connection rod 203 may be a bolt.

Specifically, before the fins 2 are mounted between flat tubes 1, the plurality of fins 2 may be connected and fastened together through the connection rod 203, and then the plurality of fins 2 connected as a whole may be mounted between the flat tubes 1. Alternatively, after the plurality of fins 2 are mounted between the flat tubes 1, the plurality of fins 2 may be fastened through the connection rod 203. In some embodiments, when the surface of the flat tube 1 is provided with the first step part 221 and the fin 2 is provided with a positioning structure, the structural strength of the fit between the flat tube 1 and the fin 2 can be effectively improved after the plurality of fins 2 are mounted and connected through the connection rod 203.

A small hole is provided in the middle of each fin 2, and the fins 2 between two flat tubes 1 may be first connected by the connection rod 203 to form a group, and then mounted between the two flat tubes 1. This structure can facilitate the collection and assembly of the fins 2 and improve the production efficiency.

Figure 11:
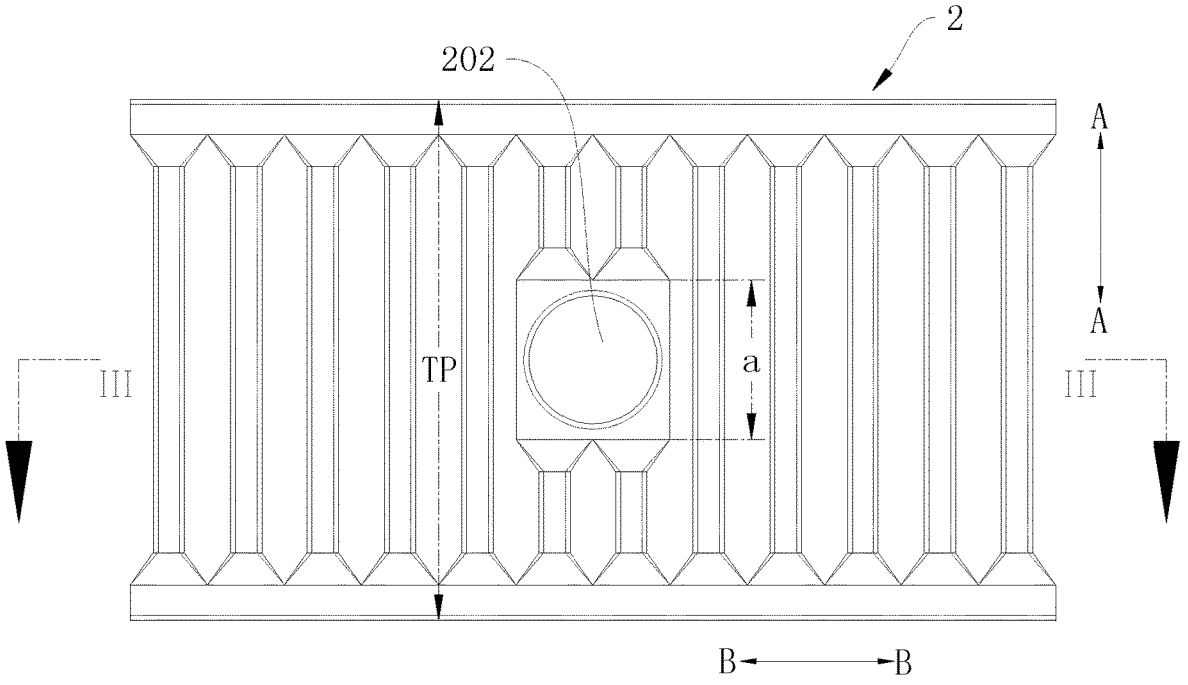
Figure 12:
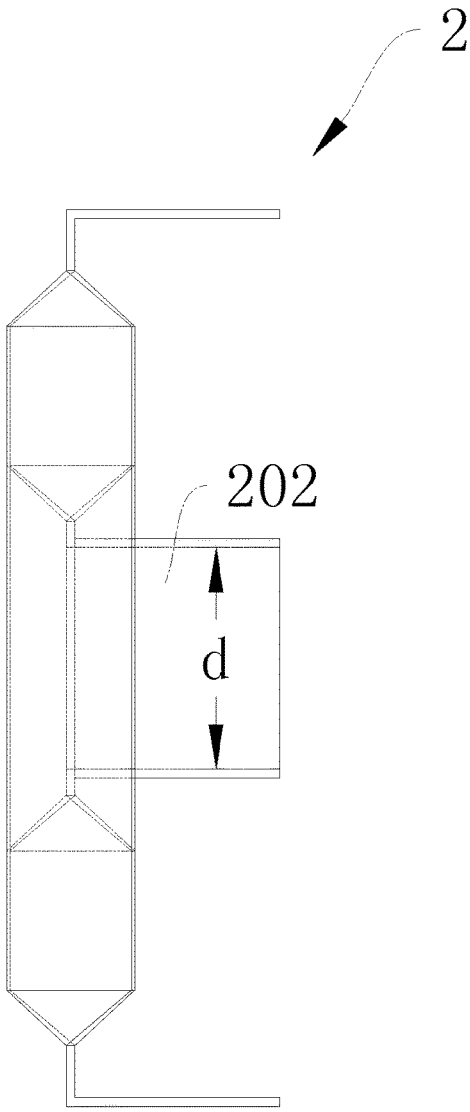
FIG. 12 is a projection view along direction B-B in FIG. 11.
Figure 13:
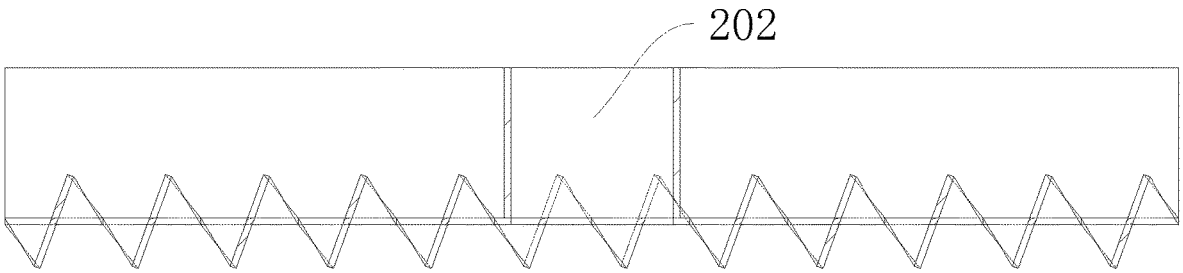
FIG. 13 is a sectional view along line III-III in FIG. 11.
Figure 14:
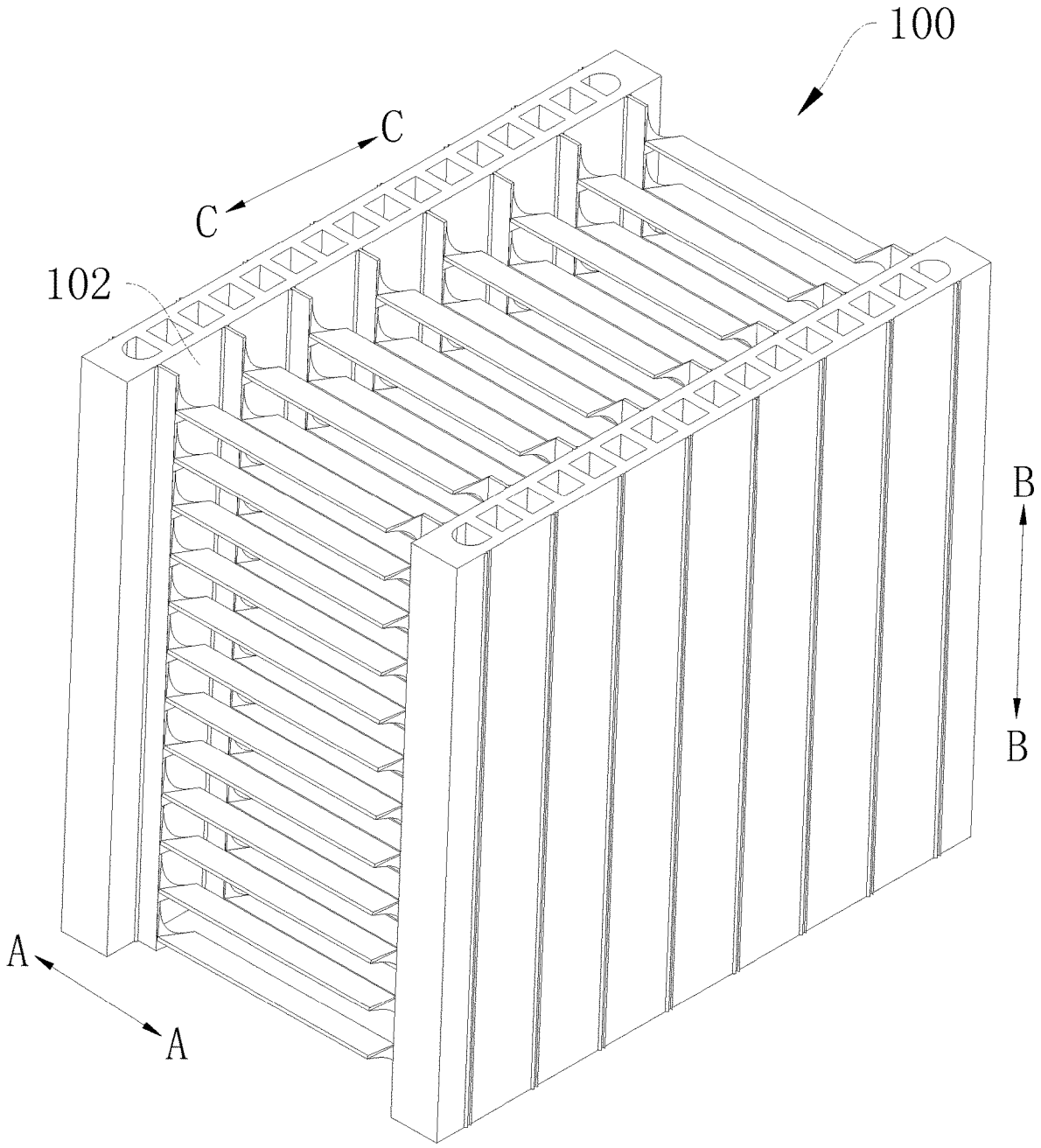
FIG. 14 is a schematic view of yet another embodiment of the present disclosure.
Figure 15:
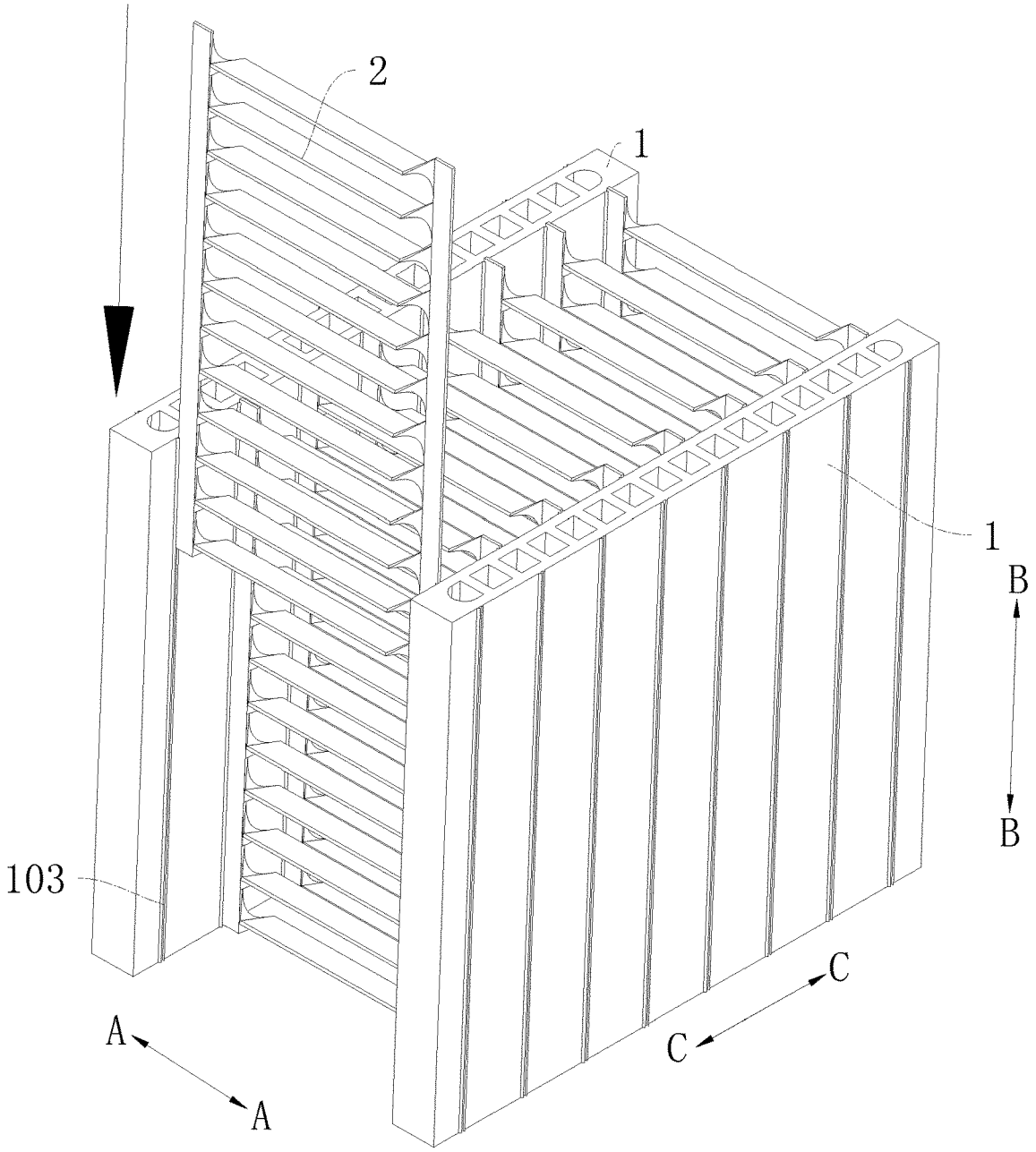
FIG. 15 is a schematic view of an assembly mode of the heat exchanger shown in FIG. 14.
Figure 16:
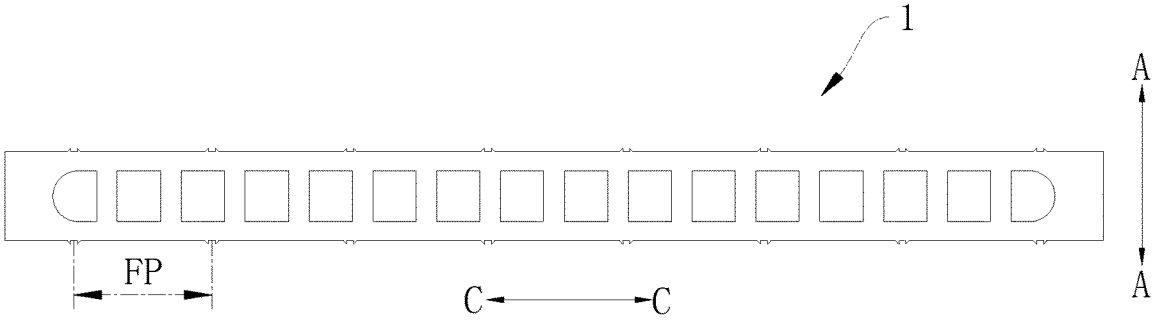
FIG. 16 is a schematic view of a flat tube in FIG. 14.

Referring to FIGS. 11 and 12, a width dimension of the fin 2 (a dimension of the fin 2 located between two adjacent flat tubes in the thickness direction of the flat tube 1) in the present disclosure may be set as TP, and the flat tube 1 is provided with a positioning block for arrangement of the connection hole 202, that is, the connection hole 202 is arranged in the positioning block. A minimum dimension of a peripheral edge of the positioning block relative to a center of the connection hole 202 is a, and a/TP may be within the range of 0.3 to 0.8. In addition, a diameter of the connection hole 202 may be d, and d/a may be set within the range of 0.5 to 0.97. Thus, the structural strength of the positioning block and the connection hole 202 can be effectively guaranteed.

Of course, in the present disclosure, the plurality of fins 2 may also be connected together through other structures, or no connection structure for connecting the plurality of fins 2 is arranged.

Referring to FIGS. 14-19, a groove 103 is arranged on the main surface 102 of the flat tube, and the groove extends along the length direction of the flat tube; a side edge of the fin 2 along the thickness direction of the flat tube is cooperatively mounted in the groove 103.

The flat tube 1 may have one main surface or two opposite main surfaces. In other words, at least one of two surfaces of the flat tube, which are opposite in the thickness direction of the flat tube, is the main surface.

Specifically, the flat tube has the main surface 102, the main surface of the flat tube is a plane defined by the width direction and the length direction, and each flat tube has two main surfaces opposite each other in the thickness direction of the flat tube. The fin 2 is arranged between main surfaces of adjacent flat tubes, and is connected to or faces the main surfaces of the flat tubes. In other words, in two adjacent flat tubes 1, main surfaces 102 of the two flat tubes are right opposite. Each flat tube 1 may have a plurality of main surfaces. For example, in three flat tubes 1 adjacent to each other along the thickness direction of the flat tube 1, two side surfaces of the flat tube 1 in the middle are opposite to the flat tubes located on both sides, so the flat tube in the middle has two main surfaces. The groove 103 is arranged on the main surface 102 of the flat tube, and the groove 103 on the main surface of the flat tube 1 may extend along the length direction of the flat tube 1. During the assembly of the fin 2, the groove 103 on the main surface of the flat tube 1 may be used as a guide groove, so that the longitudinal side edge of the fin 2 may be inserted into the groove 103 on the main surface of the flat tube 1, and the flat tube 1 is positioned.

In addition, in order to keep the flat tube structure consistent and facilitate the production and manufacture of the flat tube, the groove may also be arranged on a surface on the flat tube which is not opposite to the fin, that is, the grooves are arranged on both side surfaces of the flat tube along the thickness direction.

The groove 103 may mainly position a second end of the fin 2 along the width direction of the flat tube 1, while the degree of freedom of the fin 2 along the length direction of the flat tube 1 may be realized in different ways. For example, the fin 2 is designed in interference fit with the groove 103; the fin 2 is welded to the flat tube 1; the flat tube 1 is provided with a positioning structure; or the fin 2 is provided with a positioning structure. The positioning between the flat tube 1 and the fin 2 in the present disclosure may also adopt other positioning forms, which will not be described here.

In addition, the fin 2 may be simply inserted into the groove 103 on the main surface of the flat tube 1 without other positioning means, depending on requirements of actual use.

In addition, a plurality of bosses may be arranged on the main surface of the flat tube and spaced along the width direction of the flat tube, each of the bosses extends along the length direction of the flat tube, and an edge of the fin along the thickness direction of the flat tube is cooperatively mounted between two adjacent bosses.

Figure 17:
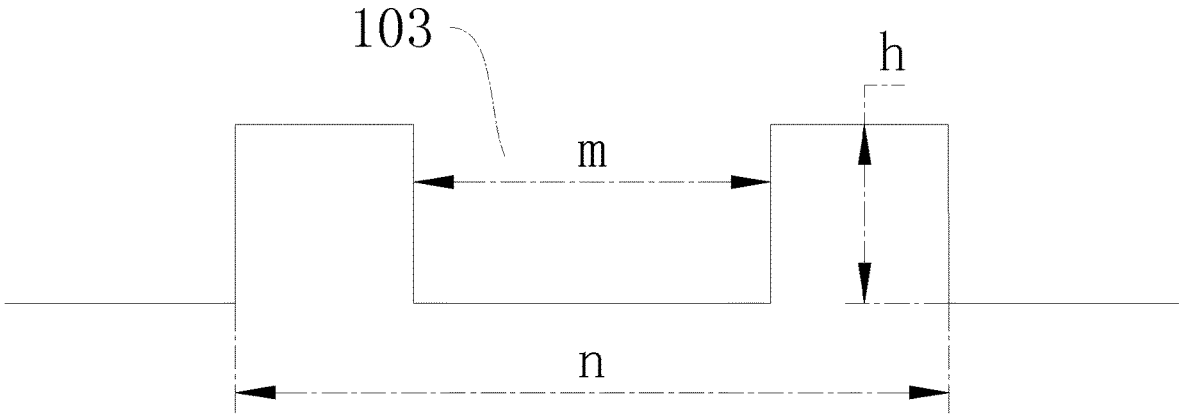
FIG. 17 and FIG. 18 are schematic views of groove shapes of different embodiments in FIG. 14.
Figure 18:
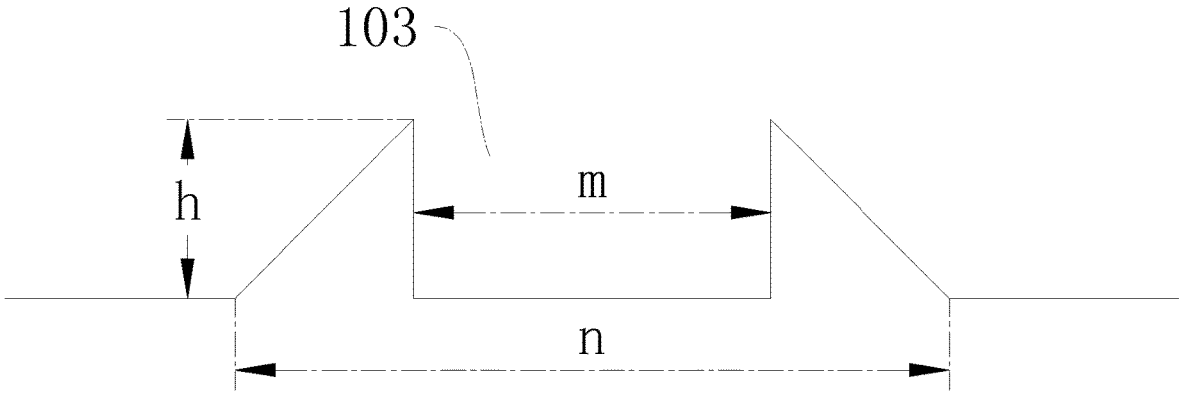
Figure 19:
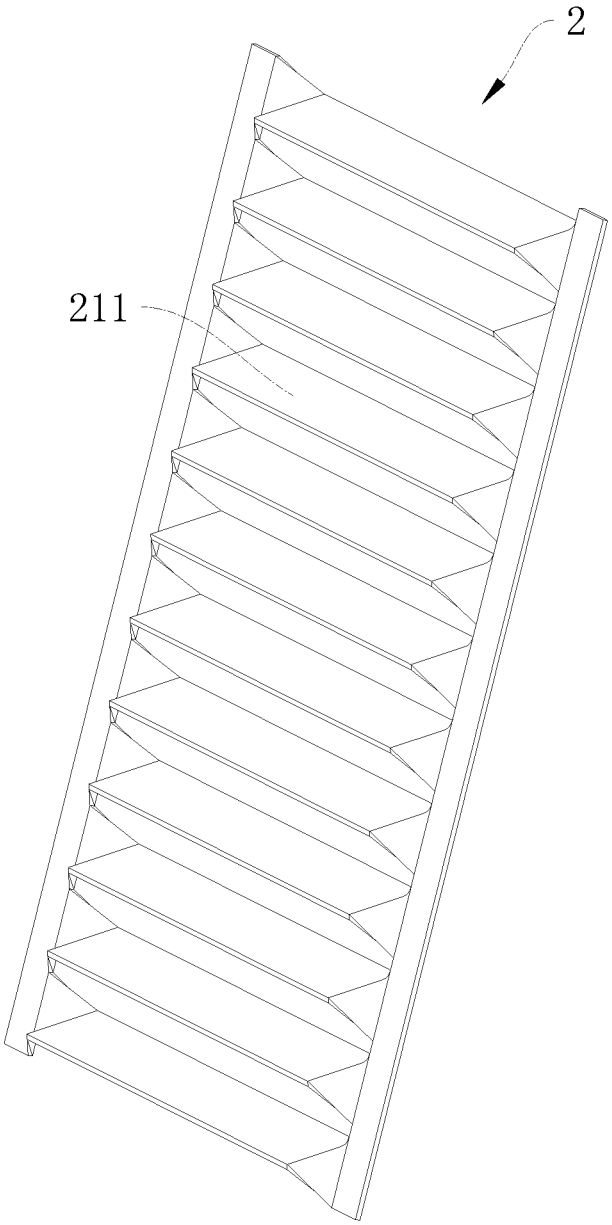
FIG. 19 is a schematic view of fins in the heat exchanger shown in FIG. 14.

Referring to FIGS. 14-19, the groove 103 may be formed by recessing a part of the main surface 102 of the flat tube, or may be formed between two adjacent bosses when the bosses are arranged on the main surface 102 of the flat tube. During assembly, the fin 2 is inserted into the groove 103 from a side of the groove 103 along the length of the flat tube 1, to form a heat exchanger unit. In such a structure, each fin 2 is independent, and each fin 2 may have a different window structure. The bosses on the flat tube 1 may be in the shape of triangle, rectangle and the like. Referring to FIGS. 17 and 18, a width dimension of the groove 103 (a dimension of the groove 103 along the width of the flat tube 1, or a distance between two adjacent bosses in the width direction of the flat tube) is m. A width of the boss (or a thickness of the boss in the width direction of the flat tube) is e, in which, a width and a gap both refer to a dimension along the width direction of the flat tube. In some embodiments, two bosses may have the same width. A thickness of the flat sheet of the fin 2 is t, which satisfies: $0.5 \le t/m \le 0.95$, and $0.2 \le m/(2e+m) < 1$.

A height of the boss in the thickness direction of the flat tube is h, and a width dimension of the fin 2 (a dimension of the fin 2 between two adjacent flat tubes in the thickness direction of the flat tube 1) may be set as TP, in which $0 < h/TP \le 0.3$.

A cross section of the boss along the thickness direction of the flat tube is triangular, rectangular or trapezoidal.

Referring to FIG. 18, when the cross section of the boss is triangular, the cross section of the boss includes a first side and a second side, the first side is perpendicular to the main surface 102 of the flat tube, the second side extends obliquely relative to the main surface 102 of the flat tube, and connects an end point of the first side and the main surface 102 of the flat tube, to form a triangular shape. The groove 103 is located between first sides of two bosses, and the second side of the cross section of the boss is located outside the groove 103.

Referring to FIG. 17, the cross section of the boss may also be in the shape of rectangle, other polygons, circle, and ellipse. The cross section is a plane perpendicular to the length direction of the flat tube.

Figure 20:
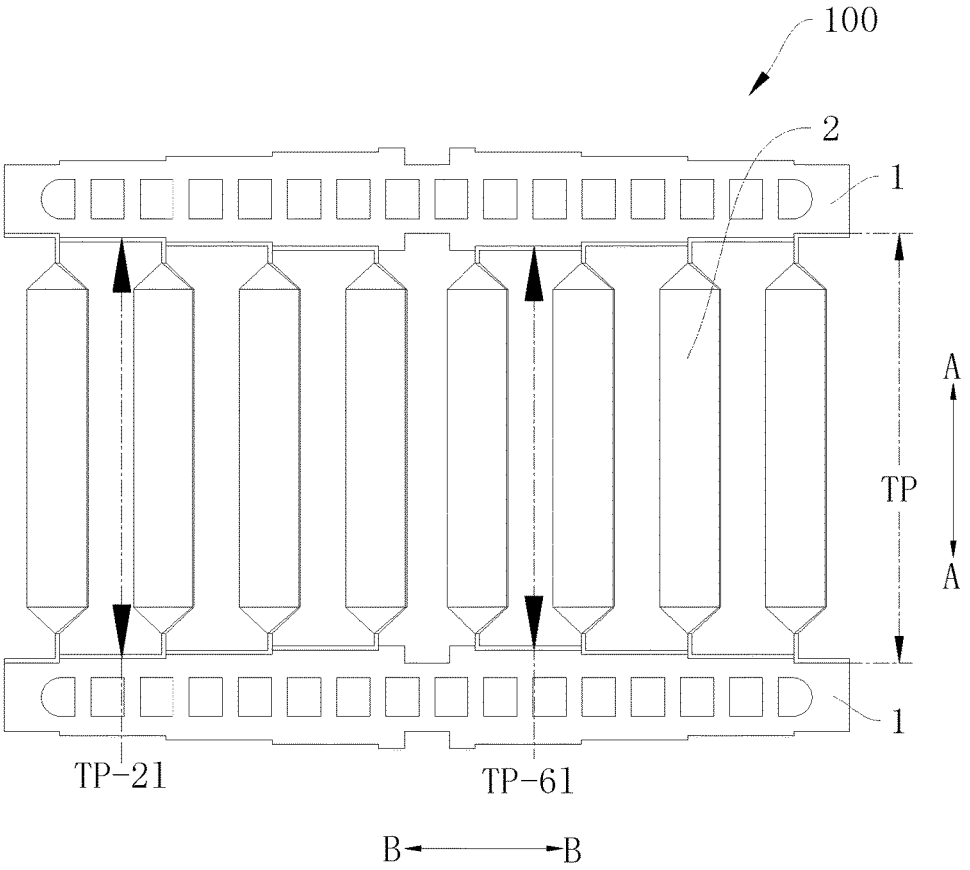
FIG. 20 is a schematic view of yet another embodiment of the present disclosure.
Figure 21:
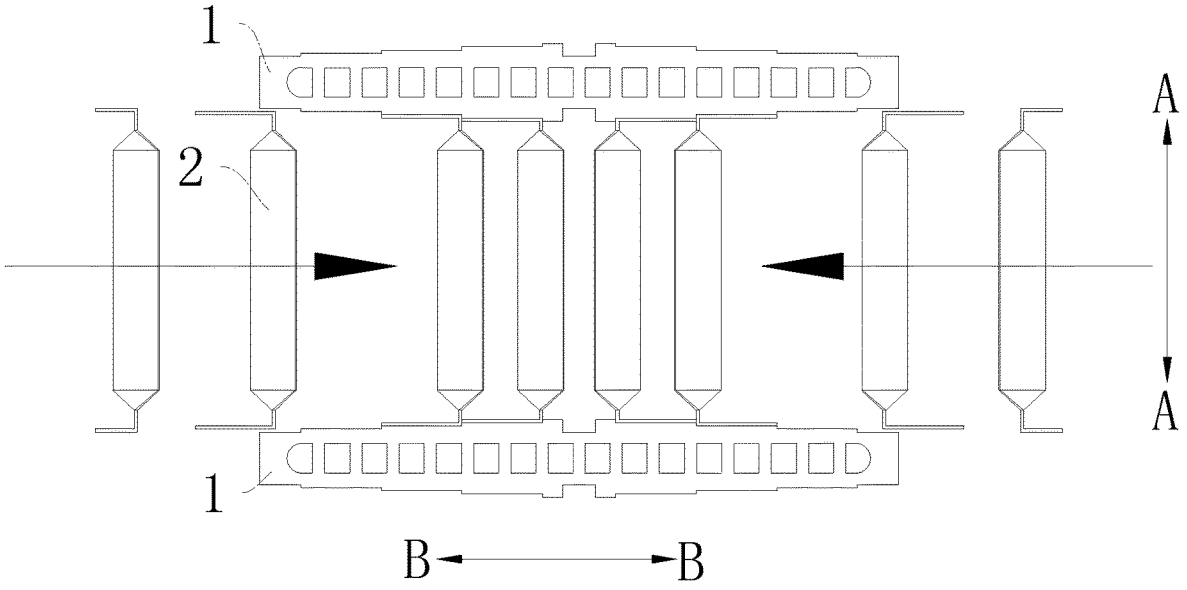
FIG. 21 is a schematic view of an assembly mode of the heat exchanger shown in FIG. 20.
Figure 22:
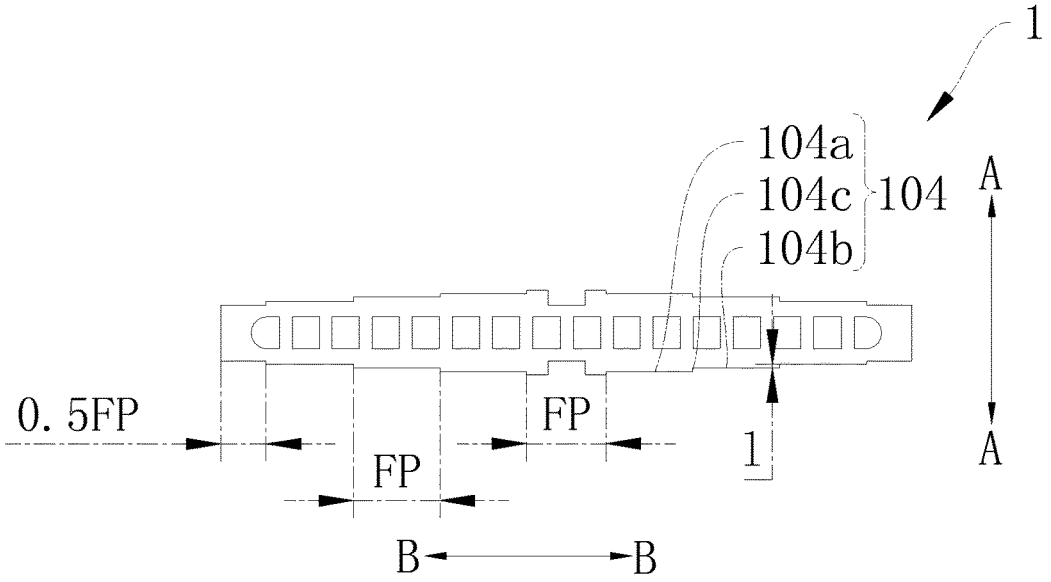
FIG. 22 is a schematic view of a flat tube in FIG. 20.

Referring to FIGS. 20-22, a plurality of second step parts 104 are arranged on the main surface 102 of the flat tube. At least two adjacent fins have different heights. The fin 2 includes a flat sheet and a positioning flange 22. At least a part of the positioning flange 22 in in contact with a platform surface of the second step part 104, and at least a part of the side edge of the fin 2 abuts against a vertical surface of the second step part 104.

The main surface 102 of the flat tube is as described above, that is, the flat tube 1 may have one main surface or two opposite main surfaces. In other words, at least one of two surfaces of the flat tube, which are opposite in the thickness direction of the flat tube, is the main surface.

The main surface 102 of the flat tube is as described above, and the second step part 104 on the main surface 102 of the flat tube may include a first surface 104*a*, a second surface 104*b*, and a second vertical surface 104*c*. Both the first surface 104*a* and the second surface 104*b* are perpendicular to the thickness direction of the flat tube 1, and the first surface 104*a* and the second surface 104*b* are not in a common surface. That is, there is a drop between the first surface 104*a* and the second surface 104*b* in the thickness direction of the flat tube 1. The second vertical surface 104*c* is connected between the first surface 104*a* and the second surface 104*b*. At this time, the second vertical surface 104*c* is formed into a vertical surface of the second step part 104. One of the first surface 104*a* and the second surface 104*b* with a lower height relative to a central plane of the flat tube perpendicular to the thickness direction of the flat tube forms the platform surface of the second step part 104.

During the assembly, the positioning flange 22 on the fin 2 cooperates with the second step part 104, in which the positioning flange 22 on the fin 2 may abut against the first surface 104*a* or the second surface 104*b* described above, and a second end or a fixed end of the positioning flange 22 may abut against the vertical surface for positioning and connection. The fixed end of the positioning flange 22 is connected to the longitudinal side edge of the fin 2, while the second end of the positioning flange 22 is away from the longitudinal side edge of the fin 2.

In addition, in the present disclosure, the second step parts 104 cooperating with the plurality of fins 2 may be designed as a plurality of second step parts 104 arranged in sequence, in which the plurality of second step parts 104 may be designed in the form of gradually lowering, gradually rising, first rising and then lowering, first lowering and then rising along the width direction of the flat tube 1.

In some embodiments, as shown in FIG. 22, a thickness of each positioning flange 22 is equal to a height of the vertical surface of the second step part 104 corresponding to this positioning flange 22. The height of the vertical surface refers to a dimension of the vertical surface along the thickness direction of the flat tube, which may effectively position the fin 2, and reduce the influence on the structural strength, wall thickness and heat exchange performance of the flat tube 1. Especially for the plurality of second step parts 104 described above, the wall thickness of the flat tube 1 may not be greatly affected. In addition, if the height of the second step part 104 is equal to the thickness of the positioning flange 22, the fin 2 may be positioned conveniently.

Of course, the height of the second step part 104 in the present disclosure may also be different from the thickness of the positioning flange 22. For example, the height of the second step part 104 is set to be greater than the thickness of the positioning flange 22; or the height of the second step part 104 is set to be less than the thickness of the positioning flange 22.

The height of the second step part 104 refers to the drop between the first surface 104*a* and the second surface 104*b* described above. In addition, the first surface 104*a* may be lower than the second surface 104*b*, or the first surface 104*a* may be higher than the second surface 104*b*, relative to the central plane perpendicular to the thickness direction of the flat tube 1.

In some embodiments, in two adjacent fins 2, the positioning flange 22 of the longitudinal side edge of one fin 2 is in contact with the other fin 2. Thus, the plurality of fins 2 can contact with each other for heat exchange, and the heat exchange efficiency of the heat exchanger 100 can be further improved effectively.

As shown in FIG. 22, the surface of the flat tube 1 has the second step part 104 to position the fin 2. When mounted, the fins 2 are pushed in one by one from both sides of the flat tube 1 (along the width of the flat tube 1), and positioned by the second step part 104 on the flat tube 1. The widths of the fins 2 decrease gradually from both ends to the middle of the flat tube 1, and the width difference of adjacent fins 2 is 2g (in which g is the height of each second step part 104, or a distance between the first surface and the second surface in the thickness direction of the flat tube). In addition, the thickness of the flat sheet of the fin is t. This structure can fix the position of the fin 2 and improve the strength of the flat tube 1, prolonging the life. The structure satisfies $0.2 \leq g/t \leq 2$.

Referring to FIGS. 23 to 26, at least two fins 2 between adjacent flat tubes 1 are connected at a transverse edge of the fin 2 by a connection plate extending along a transverse direction of the fin. In some embodiments, the connection plate is provided with a plurality of connection strips, and the plurality of connection strips are spaced from each other along the thickness direction of the flat tube. That is, two side edges in adjacent fins 2 along the transverse direction of the fin (the length of the flat tube) are connected by the plurality of connection strips spaced from each other.

In some embodiments, the connection strips in two adjacent connection plates are alternately arranged. A manufacturing method of the fin will be described below with reference to the drawings.

In other words, at least two fins 2 between adjacent flat tubes 1 are formed in one rectangular corrugated plate extending in the width direction of the flat tube, in which the width direction of the flat tube 1 may also be understood as the width direction of the flat tube. Specifically, the plurality of fins 2 are spaced from each other along the width direction of the flat tube 1, and at least one of two side edges of one fin 2 along the length direction of the flat tube 1 is connected to another adjacent fin 2 by the connection plate 23. Two side edges of one fin 2, in a middle position along the width direction of the flat tube 1, among the plurality of the fins 2 are connected to side edges of two different fins 2.

Figure 24:
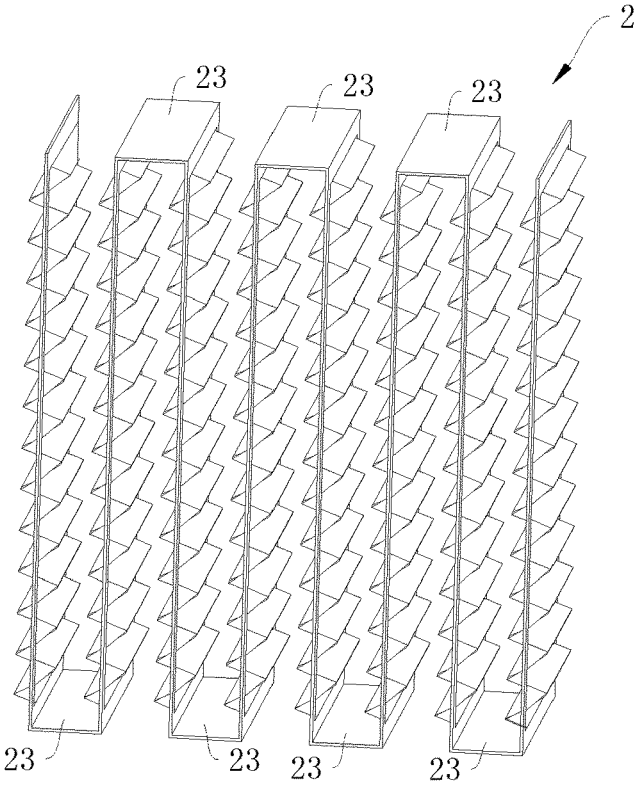
FIG. 24 and FIG. 26 are schematic views of two different forms of fins in FIG. 23.
Figure 25:
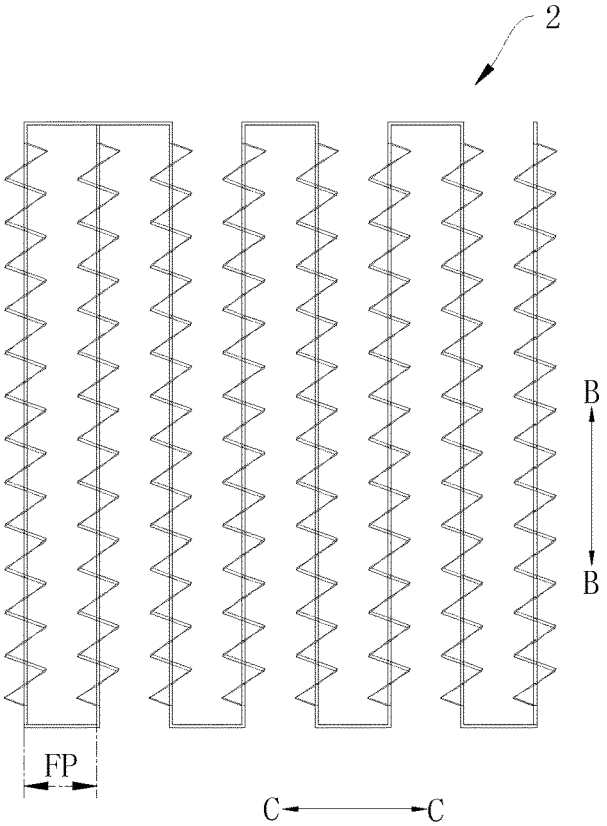
FIG. 25 is a side view of the fins in FIG. 24.

Referring to FIG. 24, the plurality of fins 2 are denoted as a first fin 2, a second fin 2, a third fin 2 . . . an nth fin 2 arranged along the width direction of the flat tube 1. Each fin 2 has a first side edge and a second side edge opposite along the length direction of the flat tube 1. First side edges of the plurality of fins 2 are opposite in the width direction of the flat tube 1, and second side edges of the plurality of fins 2 are opposite in the width direction of the flat tube 1. A first side edge of the first fin 2 is connected to a first side edge of the second fin 2 by the connection plate 23, and a second side edge of the second fin 2 is connected to a second side edge of the third fin 2 by the connection plate 23, and so on.

Figure 23:
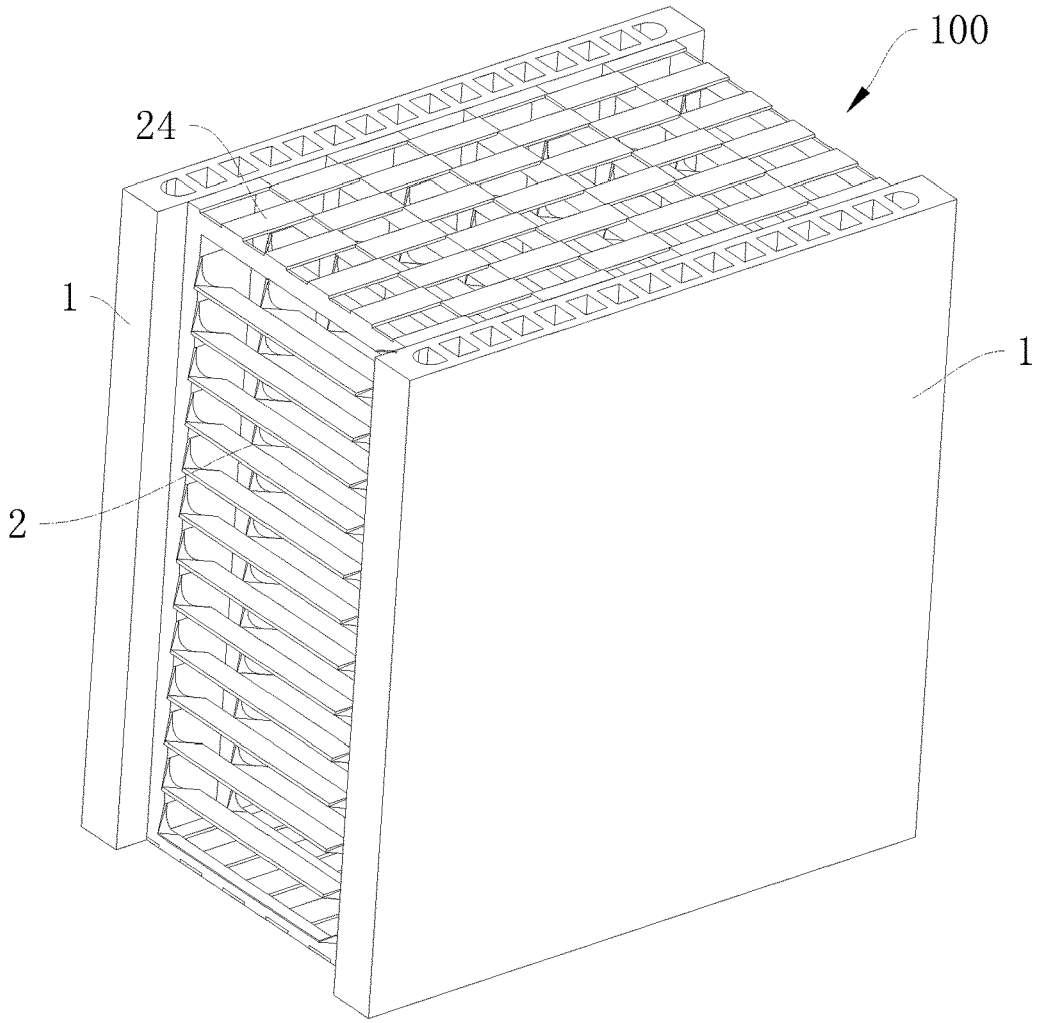
FIG. 23 is a schematic view of a heat exchanger according to yet another embodiment of the present disclosure.
Figure 26:
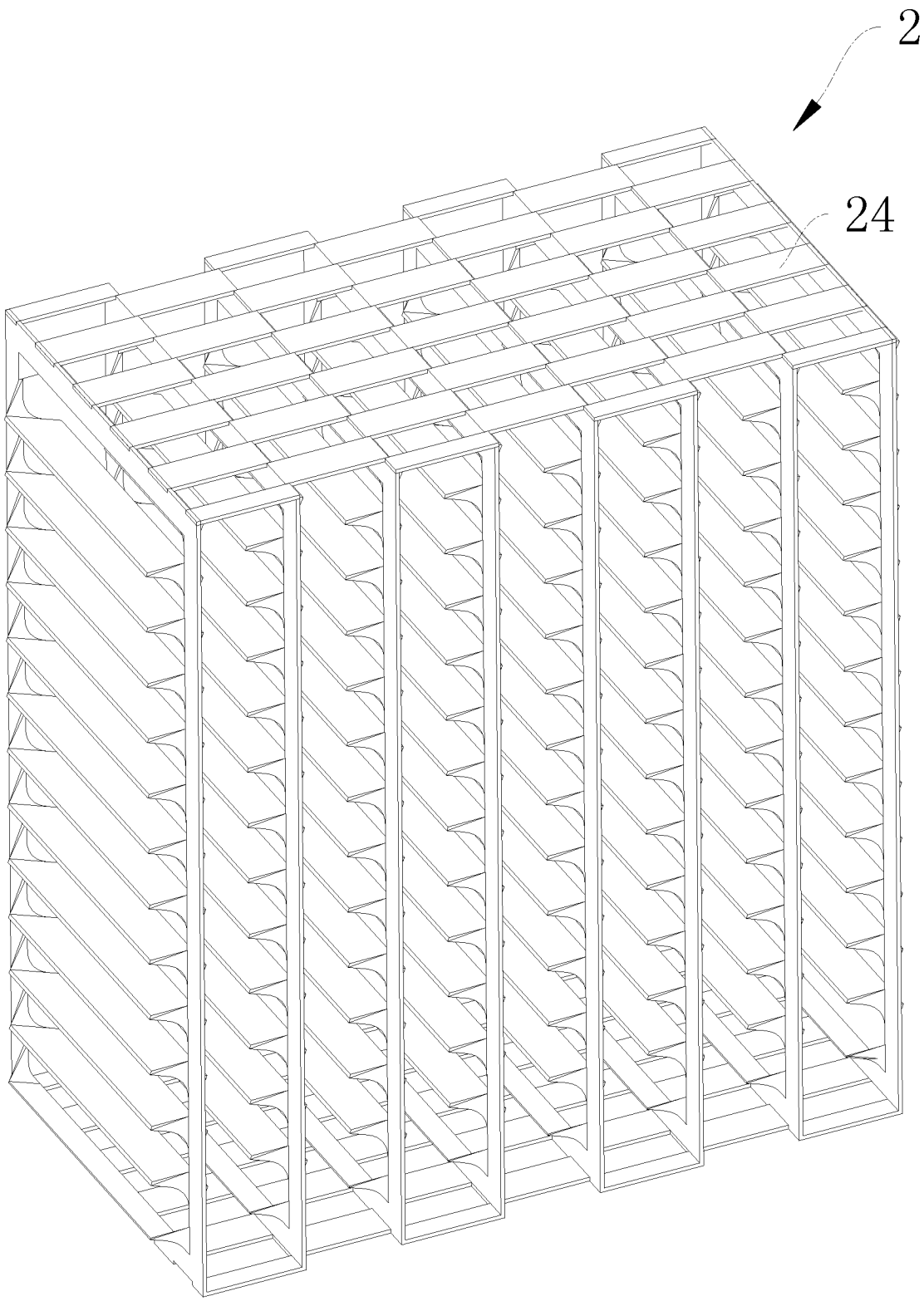

Referring to FIGS. 23 and 26, in some embodiments, the connection plate 23 of the rectangular corrugated plate is provided with a plurality of connection strips 24 formed by stamping a part of the connection plate 23, and the plurality of connection strips 24 are spaced from each other along the transverse direction of the fin 2. The connection strip 24 is turned over and connected to the adjacent fin 2 across an opening of the rectangular corrugated plate. Thus, the structural strength of the heat exchanger 100 can be enhanced effectively, and the condensate water discharge and the air circulation can be further facilitated.

Specifically, referring to FIG. 26, the connection plate 23 extends along the thickness direction of the flat tube 1. The connection plate 23 is partially stamped at predetermined intervals in the thickness direction of the flat tube 1, and through holes can be formed on the connection plate 23 by stamping. Part of the connection plate 23, which is not stamped, is formed as a connection strip 24 that still connects the original two fins 2, while the stamped part of the connection plate 23 is formed as a connection strip 24 that is connected to another fin 2 adjacent to the original two fins 2.

In other words, referring to FIG. 26, the plurality of fins 2 are denoted as a first fin 2, a second fin 2, a third fin 2 . . . an nth fin 2 arranged along the width direction of the flat tube 1. Each fin 2 has a first side edge and a second side edge opposite along the length direction of the flat tube 1. First side edges of the plurality of fins 2 are opposite in the width direction of the flat tube 1, and second side edges of the plurality of fins 2 are opposite in the width direction of the flat tube 1. A first side edge of the first fin 2 is connected to a first side edge of the second fin 2 by the plurality of connection strips 24, and the plurality of connection strips 24 are spaced from each other along the thickness direction of the flat tube 1; a second side edge of the first fin 2 is connected to a second side edge of the second fin 2 by the plurality of connection strips 24 that are spaced from each other along the thickness direction of the flat tube 1; the first side edge of the second fin 2 is connected to a first side edge of the third fin 2 by the plurality of connection strips 24 that are spaced from each other along the thickness direction of the flat tube 1; the second side edge of the second fin 2 is connected to a second side edge of the third fin 2 by the plurality of connection strips 24 that are spaced from each other along the thickness direction of the flat tube 1, and so on.

Referring to FIGS. 23 to 26, the fins 2 between two flat tubes 1 are integrated and stamped into rectangular waves. A vacant part between fins 2 is filled up by flipping a material by 180° after providing an opening in an adjacent fin top (i.e., the connection plate 23 is flipped by 180° after being perforated partially), to form a fin top structure. The opening of the fin top is used for drainage. Both sides of the fin 2 along the length of the flat tube 1 are processed with this fin top structure, thus forming a group of fins 2 and mounting the group of fins 2 between two flat tubes 1. This structure can improve the production efficiency, and facilitate drainage of the fins 2.

Referring to FIGS. 27-30, the fin 2 is provided with a positioning flange 22, and a folding edge 25 is connected to a second end of the positioning flange 22. The positioning flange of the fin is connected with the folding edge perpendicular to a second end of the positioning flange and extending in a direction away from the flat sheet of the fin. The folding edge connected to the positioning flange is arranged on a side surface of the flat tube connected to the positioning flange. Positioning flanges 22 of at least two fins 2 have unequal lengths along the width direction of the flat tube. Positioning flanges of the plurality of fins are stacked along the thickness direction of the flat tube, and folding edges of the plurality of fins are arranged along the width of the flat tube on the side surface of the flat tube.

That is, at least a part of the plurality of positioning flanges connected to the same main surface of the same flat tube have unequal lengths along the width direction of the flat tube and are stacked along the thickness direction of the flat tube. The plurality of folding edges connected to the same side surface of the same flat tube are stacked along the width direction of the flat tube.

In some embodiments, the plurality of fins 2 between adjacent flat tubes 1 are nested together in sequence along the width of the flat tube 1, and the folding edges 25 of the plurality of fins 2 between adjacent flat tubes 1 are stacked (or arranged) together in sequence along the width of the flat tube 1; the folding edge 25 of the outermost fin 2 in the width direction of the flat tube 1 snaps onto the side surface of the flat tube 1.

Figure 27:
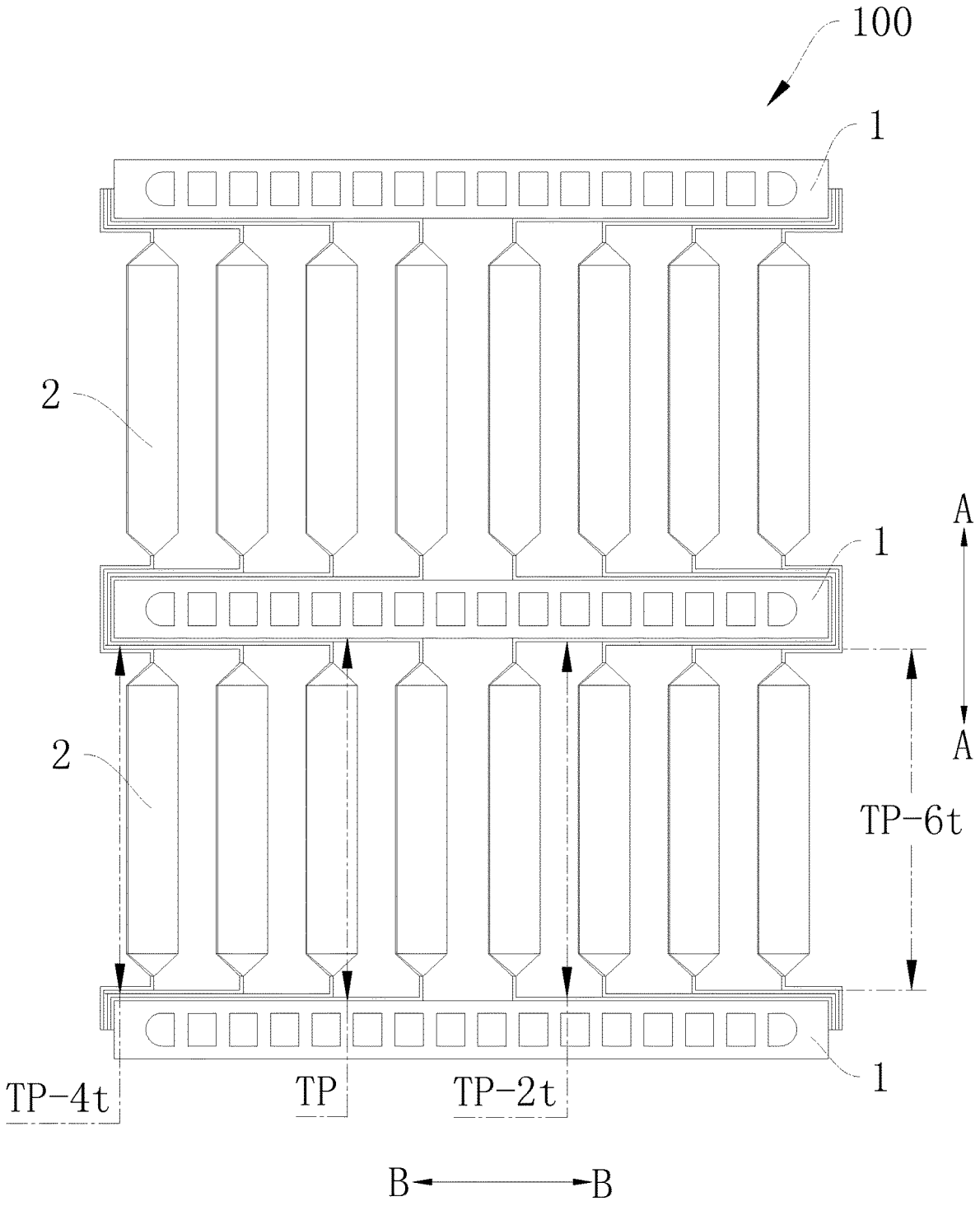
FIG. 27 is a schematic view of a heat exchanger according to yet another embodiment of the present disclosure.
Figure 28:
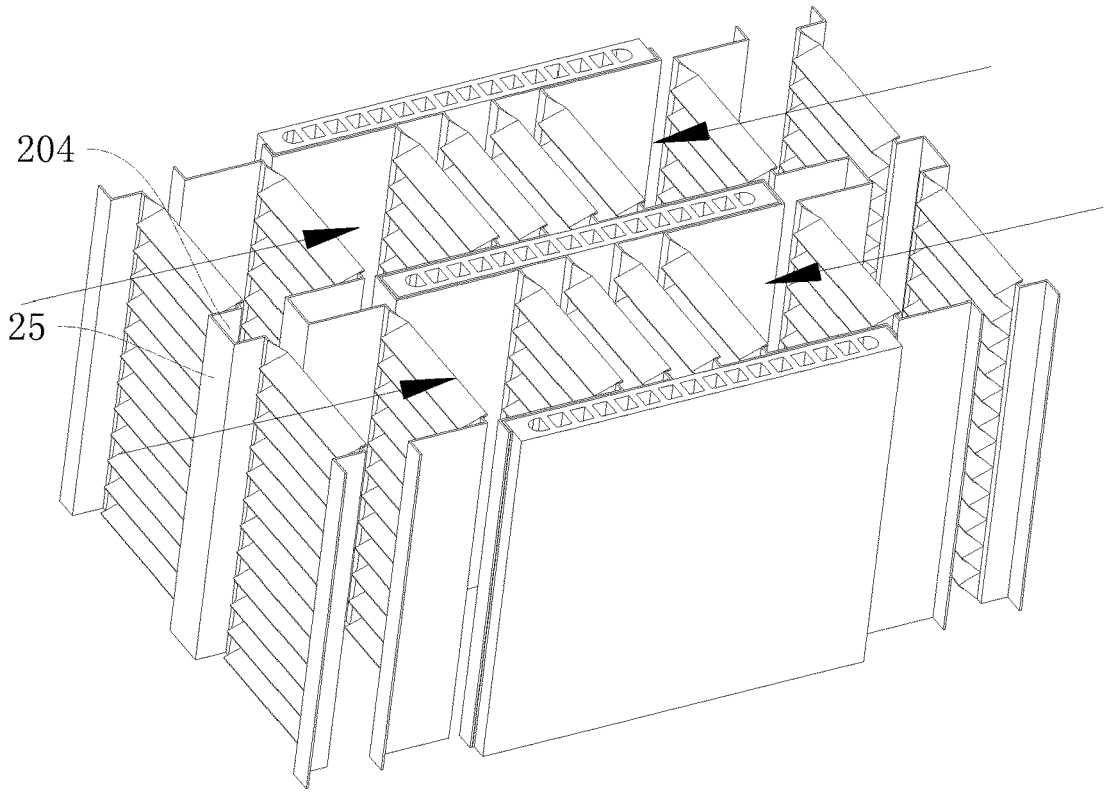
FIG. 28 is a schematic view illustrating how the heat exchanger in FIG. 27 is assembled.

Specifically, referring to FIGS. 27 and 28, the plurality of fins 2 between adjacent flat tubes 1 are nested in sequence along the width of the flat tube 1, and positioning flanges 22 of the fins 2 are also nested together in sequence in the width direction of the flat tube 1. In some embodiments, the plurality of positioning flanges 22 may be stacked along the thickness direction of the flat tube 1. In addition, the folding edges 25 of the plurality of the fins 2 are also stacked in sequence in the width of the flat tubes 1, and the plurality of folding edges 25 may be stacked on a side edge along the width of the flat tube 1. Since the plurality of fins 2 adopt the nested arrangement, the folding edge of the outermost fin 2 among the plurality of fins 2 snaps onto the flat tube 1. In some embodiments, the folding edges of other fins 2 also snap onto the folding edges of adjacent fins 2 in sequence.

Figure 29:
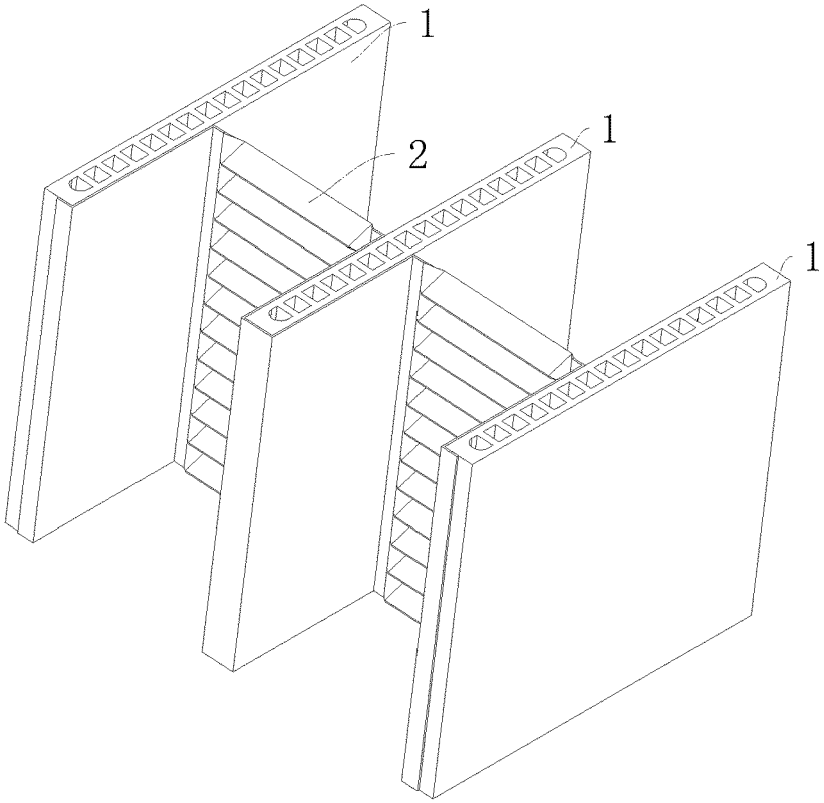
FIG. 29 is a partial schematic view of the heat exchanger in FIG. 27.
Figure 30:
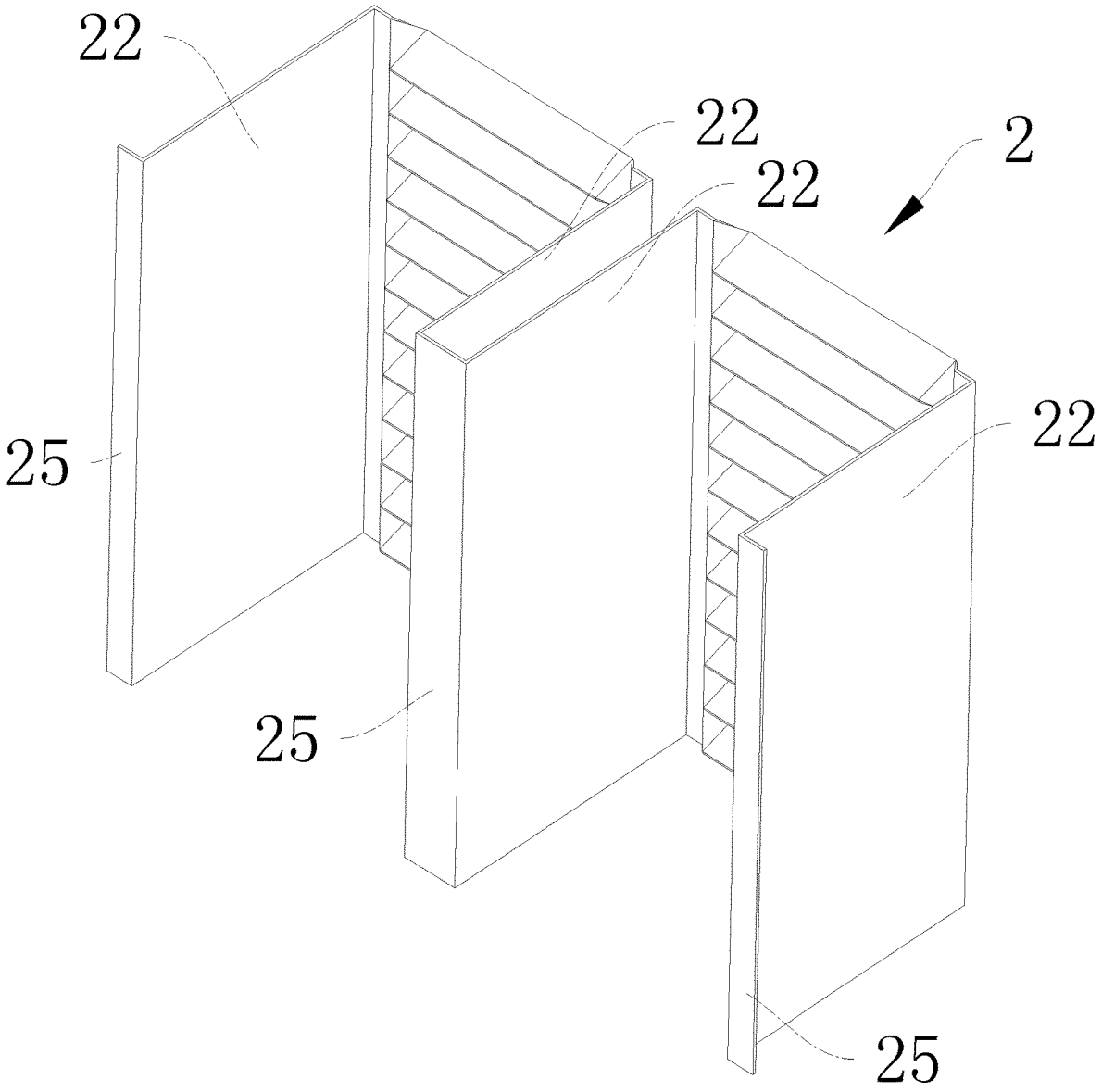
FIG. 30 is a schematic view of fins of the heat exchanger in FIG. 27.
Figure 31:
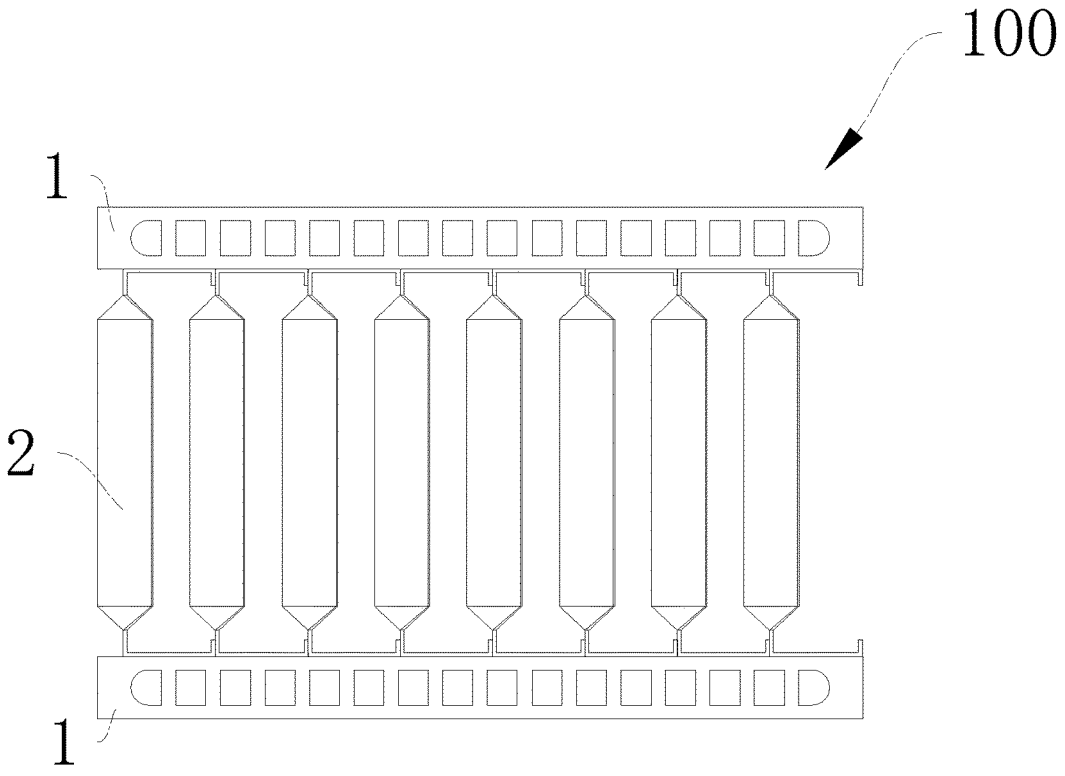
FIG. 31 is a schematic view of a heat exchanger according to yet another embodiment of the present disclosure.
Figure 32:
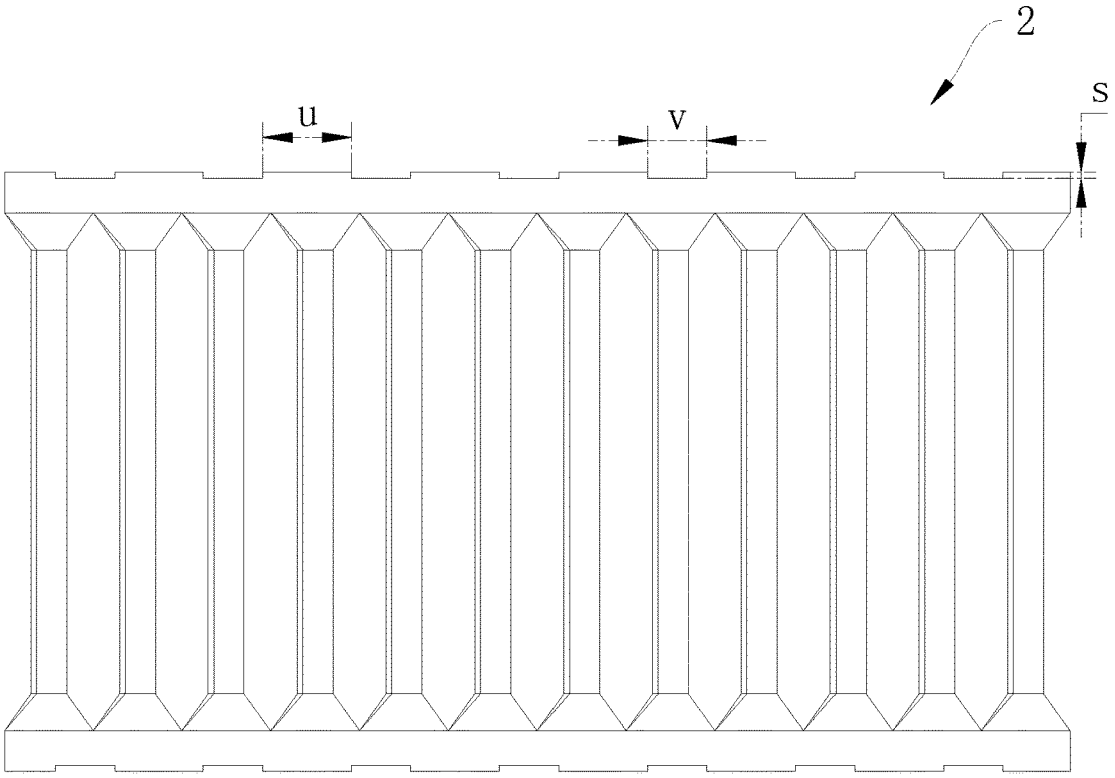
FIGS. 32-34 are schematic views of fins of the heat exchanger in FIG. 31 in different orientations.
Figure 33:
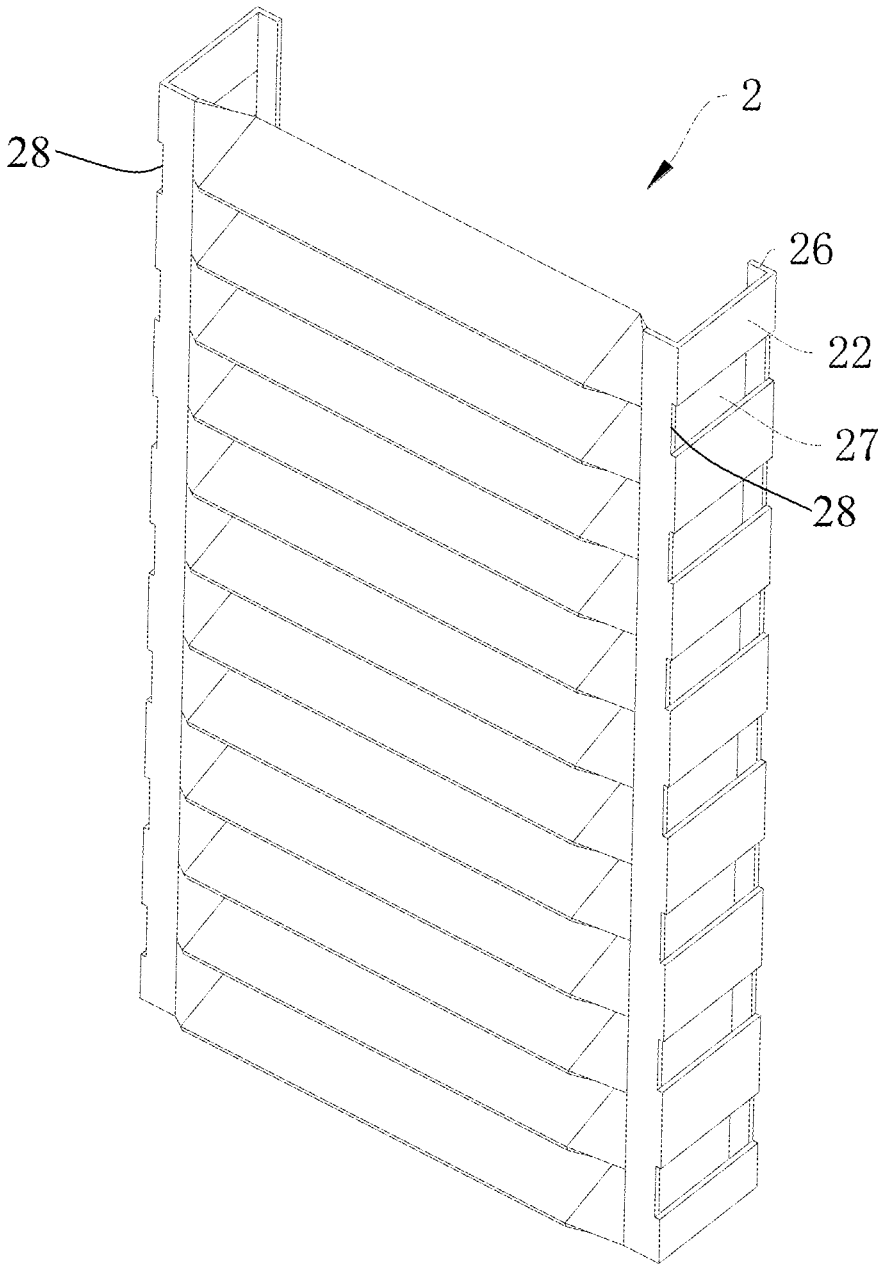
Figure 34:
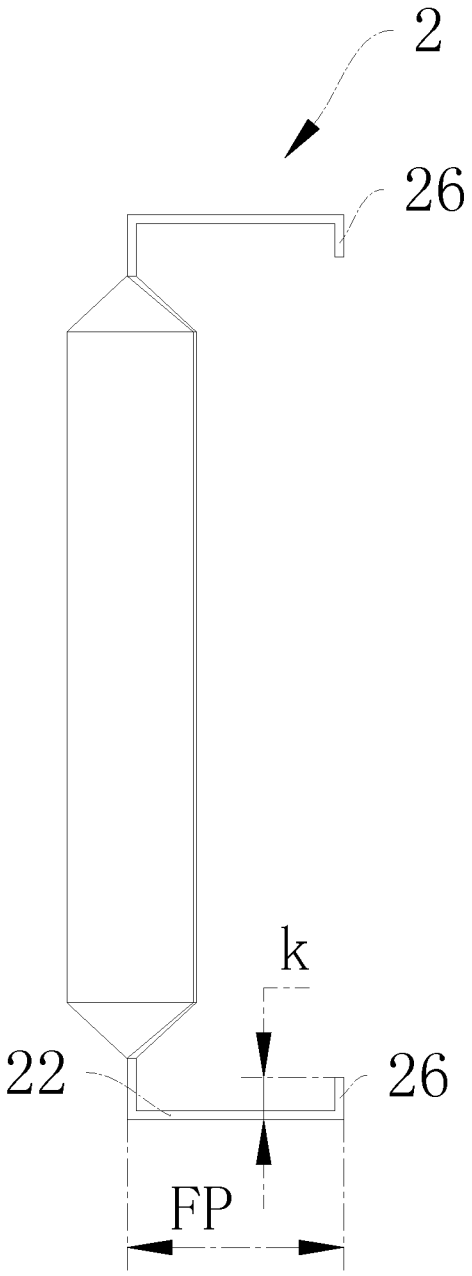

Each fin 2 of the heat exchanger 100 is integrally formed by stamping, and the fins are clamped into the flat tube 1 one by one. The widths of the fins 2 from a center of the flat tube 1 to both ends of the flat tube 1 decrease gradually. The width of an intermediate fin 2 is TP, and the width difference between adjacent fins 2 is 2t. The assembly process is shown in FIGS. 29 and 28. First, the intermediate fin 2 is mounted, and fins 2 on both sides of the flat tube 1 are mounted. This structure of the fin 2 can be formed quickly, and the assembly is convenient and fast, which can greatly improve the production efficiency.

In addition, the fins 2 in the present disclosure may be nested in sequence from one side of the flat tube 1 along the width of the flat tube 1, or from both sides of the flat tube 1 along the width of the flat tube 1 respectively. In addition, when there are more than three flat tubes 1, the fin 2 is arranged between each two adjacent flat tubes 1, and an air flow channel is formed between two adjacent flat tubes 1. In different air flow channels, the fin 2 may be connected together by the folding edges.

Referring to FIGS. 27-30, the fin 2 is provided with a positioning flange 22, and a folding edge 25 is arranged on a second end of the positioning flange 22. Along the width of the flat tube 1, the plurality of fins 2 between adjacent flat tubes 1 are divided into two groups, and positioning flanges of each group of fins are stacked along the thickness direction of the flat tube.

Specifically, the plurality of fins between two adjacent flat tubes are divided into two groups. The positioning flanges of the fins in each group extend, from a first end to the second end, towards the same side along the width direction of the flat tube, and the positioning flanges of the fins in different groups extend, from the first end to the second end, towards opposite directions along the width direction of the flat tube. Folding edges connected to a plurality of positioning flanges, connected to the same flat tube, of the fins in each group are arranged on the same side surface of the flat tube, and folding edges connected to a plurality of positioning flanges, connected to the same flat tube, of the fins in different groups are arranged on different side surfaces of the flat tube. At least a part of the plurality of positioning flanges connected to the same main surface of the same flat tube in each group of fins have unequal lengths along the width direction of the flat tube and are stacked along the thickness direction of the flat tube; and a plurality of folding edges connected to the same side surface of the same flat tube in each group of fins are stacked along the width direction of the flat tube.

In some embodiments, each group of fins 2 are nested in sequence along the width of the flat tube 1, the folding edges 25 in each group of fins 2 are stacked (or arranged) along the width of the flat tube 1, and the folding edge 25 of the outermost fin 2 in the width direction of the flat tube 1 snaps onto a side edge of the flat tube 1 along the length of the flat tube.

Specifically, the folding edges in a group of fins are stacked (or arranged) in sequence on one side surface of the flat tube along the width of the flat tube, and the folding edges in another group of fins are stacked (or arranged) in sequence on another side surface of the flat tube along the width of the flat tube.

The fins 2 may be mounted between the flat tubes 1 along the width of the flat tube 1, and the fins 2 may be mounted from both sides of the flat tube 1 along the width, which makes the assembly easier. In addition, if the fins 2 are mounted from only one side of the flat tube 1 along the width, the positioning flanges 22 of the plurality of fins 2 may affect the thermal conduction between the flat tube 1 and fins 2. Moreover, during nesting, the positioning flange 22 of the outermost fin 2 among the plurality of fins 2 may be relatively wide (a dimension along the width of the flat tube 1), which further affects the effect of thermal conduction between the fins 2 and the flat tube 1, and affects the stability of fitting between the flat tube 1 and the fins 2. By mounting the fins 2 from both sides of the flat tube 1 along the width, these problems can be solved effectively, the effect of thermal conduction between the fins 2 and the flat tube 1 can be effectively improved, and the structural strength of connection between the flat tube 1 and the fins 2 can be enhanced.

In addition, mounting the fins 2 from one side of the flat tube 1 along the width also falls into the protection scope of the present disclosure.

Referring to FIGS. 27-30, there are more than three flat tubes 1. Among three flat tubes 1, flat sheets of the fins between two adjacent flat tubes in one group are parallel to flat sheets of the fins between two adjacent flat tubes in another group. Folding edges on one side of the fins between two adjacent flat tubes in one group and folding edges on one side of the fins between two adjacent flat tubes in another group are connected on a side surface of the flat tube located in the middle, and the folding edges are parallel to each other in the width direction of the flat tube.

In some embodiments, along the width of the flat tube 1, fins 2 are divided into two groups. Positioning flanges 22 of each group of fins 2 are stacked along the thickness direction of the flat tube 1. Folding edges 25 of one group of fins 2 are stacked in sequence along the width of the flat tube 1 on one side surface of the flat tube, and folding edges of another group of fins are stacked in sequence along the width of the flat tube 1 on another side surface of the flat tube. In the width direction of the flat tube 1, the folding edge 25 of the outermost fin 2 snaps onto a side edge of the flat tube 1 along the length.

The efficiency of forming and mounting the fins 2 can be improved effectively by connecting the plurality of fins 2 together. Moreover, the positioning of the plurality of the flat tubes 1 can be realized by the fins 2, and the assembly efficiency of the heat exchanger 100 can be further effectively improved.

In some embodiments, the fin includes two positioning flanges that are connected to two side edges of the flat sheet respectively.

Referring to FIGS. 31 to 35, in the above embodiments of the present disclosure where positioning flanges 22 are provided, an opening 27 may be arranged in the positioning flange 22. In some embodiments, the positioning flange 22 is provided with a plurality of holes spaced along the length of the flat tube 1, that is, the positioning flange 22 is provided with a plurality of openings along the length direction of the flat tube 1. The distance between two adjacent openings in the positioning flange along the length direction of the flat tube (a length of the positioning flange along the length direction of the flat tube) is u, and a length of the opening along the length direction of the flat tube 1 may be set as v. The fin 2 forms a depression 28 at the opening of the positioning flange 22, and a depth of the depression 28 is s (in some embodiments, the depth of the depression 28 is not less than a thickness of the positioning flange 22).

In addition, for the above structures (especially for the structures shown in FIGS. 1-5 and 20-22), a positioning tab 26 may be arranged at the second end of the positioning flange 22 for positioning between adjacent fins 2. After the assembly of the fin 2 and the flat tube 1, the positioning tab 26 abuts against the vertical surface of the second step part 104 on the flat tube 1 or against another fin 2. A width of the positioning tab 26 (a dimension along the thickness direction of the flat tube 1; or an extension distance of the positioning tab extending away from the second end of the positioning flange along the thickness direction of the flat tube) may be k, and a distance between fins 2 may be FP.

By providing the opening 27 and the positioning tab 26, the soldering of the heat exchanger 100 can be facilitated. During the soldering, a soldering flux may permeate into the gap between fin 2 and the flat tube 1 from the opening, so that the soldering effect is better.

In addition, a thickness of the flat sheet of the fin 2 is t, in which $1<k/t\leq 10$, $t\leq s\leq k$, and $0.1\leq u/v\leq 10$.

Figure 35:
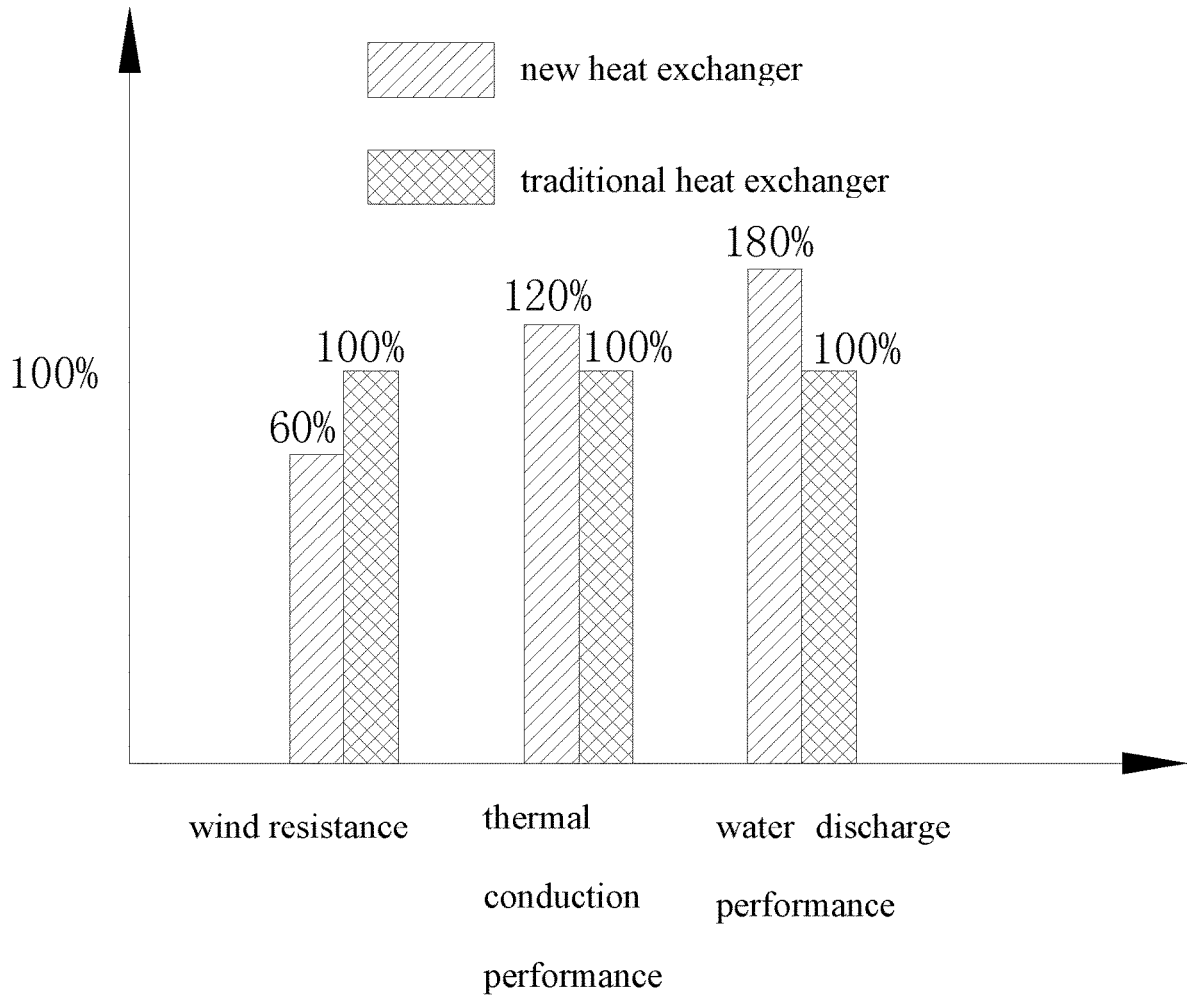
FIG. 35 is a schematic view illustrating comparison of test results of the heat exchanger according to embodiments of the present disclosure and the heat exchanger in the related art.

According to the above embodiments of the present disclosure, a water flow path on the air side is changed, so that the water is quickly discharged from the gap between the fins 2. Since the water is quickly discharged and does not remain, the wind resistance can be reduced; moreover, since less water remains, thermal resistance of a water film can be reduced, and the heat exchange performance can be improved. According to the experimental data, there are experimental results as shown in FIG. 35.

In the present disclosure, the flat tubes 1 and the fins 2 in the heat exchanger 100 are vertically arranged. The plurality of fins 2 are arranged in parallel along the width direction of the flat tube 1, and the thickness direction of the fin 2 is consistent with the width direction of the flat tube 1. The fin 2 is formed by stamping or other methods, and the fin 2 is positioned by various flanges or snap slots. The air flows through the window gap of the fin 2, and the water on the air side is quickly discharged from the gap between the fins 2.

In the description of the present disclosure, it should be understood that terms "longitudinal," "transverse," "length," "width" and "thickness" refer to the orientation or position relationship shown in the drawings. These terms are only for the convenience of describing the present disclosure and simplifying the description, and do not indicate or imply that the device or the element indicated must have a particular orientation, or be constructed and operated in a particular orientation. Therefore, these terms shall not be understood as limitation on the present disclosure.

In addition, the terms "first" and "second" are merely used for the purpose of description and cannot be understood as indicating or implying relative importance or the number of technical features indicated. Thus, the features defined with "first" and "second" may explicitly or implicitly include at least one feature. In the description of the present disclosure, "a plurality of" means at least two, such as two and three, unless otherwise explicitly and specifically defined.

In the present disclosure, unless otherwise explicitly specified and defined, the terms "mounted," "connected," "coupled," "fixed" and the like shall be understood broadly, and may be, for example, fixed connections, detachable connections, or integral connections; may also be mechanical or electrical connections; may also be direct connections or indirect connections via intervening structures; may also be inner communications of two elements, which can be understood by those skilled in the art according to specific situations.

In the present disclosure, unless otherwise explicitly specified and defined, a structure in which a first feature is "on" or "below" a second feature may include an embodiment in which the first feature is in direct contact with the second feature, and may also include an embodiment in which the first feature and the second feature are not in direct contact with each other, but are contacted via an additional feature formed therebetween. Furthermore, a first feature "on," "above," or "on top of" a second feature may include an embodiment in which the first feature is right or obliquely "on," "above," or "on top of" the second feature, or just means that the first feature is at a height higher than that of the second feature; while a first feature "below," "under," or "on bottom of" a second feature may include an embodiment in which the first feature is right or obliquely "below," "under," or "on bottom of" the second feature, or just means that the first feature is at a height lower than that of the second feature.

Although the embodiments of the present disclosure have been shown and described above, it may be understood that the above embodiments are exemplary and shall not be understood as limitation on the present disclosure, and changes, modifications, alternatives and variations can be made in the above embodiments within the scope of the present disclosure.

What is claimed is:

1. A heat exchanger, comprising:

a plurality of flat tubes, spaced from each other along a width direction of the flat tubes, wherein a fluid channel is arranged in each of the flat tubes and extends along a length direction of the flat tubes, and each of the flat tubes has two main surfaces opposite along a thickness direction of the flat tubes and has two side surfaces opposite along the width direction of the flat tubes; and a plurality of fins arranged between adjacent flat tubes in the thickness direction of the flat tubes and spaced apart from each other in the width direction of the flat tubes, and each of the plurality of fins extends along the length direction of the flat tubes and is provided with a ventilation window, wherein:

at least a first fin of the plurality of fins comprises a flat sheet and a positioning flange, wherein the flat sheet extends along the thickness direction of the flat tubes and has two opposite side edges along the thickness direction of the flat tube; the positioning flange of the first fin is connected to one of the two side edges of the flat sheet of the first fin and extends towards an adjacent fin of the plurality of fins;

a plurality of openings are arranged in the positioning flange along the length direction of the flat tubes, and the first fin forms a depression at each opening of the positioning flange, a depth of the depression being not less than a thickness of the positioning flange.

2. The heat exchanger according to claim 1, wherein the positioning flange of the first fin has a first end connecting the flat sheet of the fin and a second end away from the flat sheet of the first fin; and a plurality of ventilation windows are arranged on the flat sheet along the length direction of the flat tubes.

3. The heat exchanger according to claim 2, wherein each of the plurality of ventilation windows comprises a louvre blade connected to the flat sheet and an opening in the flat sheet.

4. The heat exchanger according to claim 2, wherein a distance between two adjacent openings in the positioning flange in the length direction of the flat tubes is u, and a length of the opening in the length direction of the flat tubes is v, wherein $0.1 \leq u/v \leq 10$.

5. The heat exchanger according to claim 2, wherein the second end of the positioning flange is provided with a positioning tab, the positioning tab extends away from the second end of the positioning flange along the thickness direction of the flat tubes, with an extension distance of k, and a thickness of the flat sheet of the first fin is t, wherein $1 < k/t \leq 10$.

* * * * *